US007866786B2

(12) United States Patent
Matsuzawa

(10) Patent No.: US 7,866,786 B2
(45) Date of Patent: Jan. 11, 2011

(54) LIQUID EJECTING METHOD, LIQUID EJECTING APPARATUS, AND STORAGE MEDIUM HAVING PROGRAM STORED THEREON

(75) Inventor: Yoshihiko Matsuzawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 187 days.

(21) Appl. No.: 12/317,726

(22) Filed: Dec. 29, 2008

(65) Prior Publication Data

US 2009/0160895 A1 Jun. 25, 2009

(30) Foreign Application Priority Data

Dec. 25, 2007 (JP) ..... 2007-332722

(51) Int. Cl.
*B41J 29/393* (2006.01)

(52) U.S. Cl. ..... 347/19; 347/41

(58) Field of Classification Search ..... 347/12, 347/14, 15, 19, 41
See application file for complete search history.

(56) References Cited

U.S. PATENT DOCUMENTS 5,729,259 A * 3/1998 Gotoh et al. ..... 347/43
6,554,385 B2 * 4/2003 Kikuchi et al. ..... 347/15
6,601,939 B2 * 8/2003 Fujita et al. ..... 347/15

FOREIGN PATENT DOCUMENTS

JP 10-323978 12/1998
JP 2005-001328 1/2005
JP 2005-014438 1/2005

* cited by examiner

*Primary Examiner*—Lamson D Nguyen
(74) *Attorney, Agent, or Firm*—Nutter McClennen & Fish LLP; John J. Penny, V

(57) ABSTRACT

A liquid ejecting method according to the present invention includes the following: varying dots that are to constitute a dot row that is to be formed with a first nozzle row and a second nozzle row, according to a usage rate of each of the first and second nozzle rows when forming that dot row, the first nozzle row including a plurality of first nozzles lined up in a transport direction, the second nozzle row including a plurality of second nozzles in the transport direction, the first nozzles of the first nozzle row forming dots on a medium by ejecting liquid while moving in a movement direction, the second nozzles of the second nozzle row forming dots on the medium by ejecting liquid while moving in the movement direction, the dot row that has been formed on the medium being composed of a plurality of the dots to be lined up on the medium in the movement direction; and forming a plurality of the dot rows in the transport direction by alternately repeating a transport operation of transporting the medium in the transport direction and a dot forming operation of forming a dot on the medium by ejecting liquid from the first nozzles and the second nozzles while the first and second nozzles moving in the movement direction, at least one of the dot rows that have been formed by the first and second nozzles being composed of the dots that are varied according to the usage rate of each of the first nozzle row and the second nozzle row.

8 Claims, 26 Drawing Sheets

| INK | FIRST NOZZLE ROW GROUP | | | SECOND NOZZLE ROW GROUP | | |
|---|---|---|---|---|---|---|
| | SMALL DOT | MEDIUM DOT | LARGE DOT | SMALL DOT | MEDIUM DOT | LARGE DOT |
| C | 101 | 106 | 97 | 100 | 99 | 96 |
| M | 95 | 98 | 97 | 105 | 101 | 102 |
| Y | 105 | 95 | 97 | 101 | 102 | 100 |
| K | 110 | 108 | 105 | 99 | 109 | 98 |
| LC | 102 | 102 | 105 | 97 | 98 | 102 |
| LM | 96 | 96 | 101 | 102 | 97 | 96 |
| LK | 93 | 101 | 93 | 101 | 100 | 93 |
| LLK | 97 | 102 | 95 | 93 | 101 | 94 |

FIG. 15

| FIRST NOZZLE ROW | | | SECOND NOZZLE ROW | | |
|---|---|---|---|---|---|
| SMALL DOT (5ng) | MEDIUM DOT (10ng) | LARGE DOT (20ng) | SMALL DOT (5ng) | MEDIUM DOT (10ng) | LARGE DOT (20ng) |
| 95(%) | 106(%) | 97(%) | 103(%) | 90(%) | 105(%) |

FIG. 19

| FIRST NOZZLE ROW USAGE RATE | SECOND NOZZLE ROW USAGE RATE | EXPECTED CHARACTERISTIC (%) | | | EXPECTED INK AMOUNT | | |
|---|---|---|---|---|---|---|---|
| | | SMALL DOT (5ng) | MEDIUM DOT (10ng) | LARGE DOT (20ng) | SMALL DOT (5ng) | MEDIUM DOT (10ng) | LARGE DOT (20ng) |
| 1 | 0 | 95.0 | 106.0 | 97.0 | 4.70 | 10.60 | 19.40 |
| 0.9 | 0.1 | 95.8 | 104.4 | 97.8 | 4.79 | 10.44 | 19.56 |
| 0.8 | 0.2 | 96.6 | 102.8 | 98.6 | 4.83 | 10.28 | 19.72 |
| 0.7 | 0.3 | 97.4 | 101.2 | 99.4 | 4.87 | 10.12 | 19.88 |
| 0.6 | 0.4 | 98.2 | 99.6 | 100.2 | 4.91 | 9.96 | 20.04 |
| 0.5 | 0.5 | 99.0 | 98.0 | 101.0 | 4.95 | 9.80 | 20.20 |

EXPECTED CHARACTERISTIC (%)
= FIRST NOZZLE ROW CHARACTERISTIC (%) × FIRST NOZZLE ROW USAGE RATE
+ SECOND NOZZLE ROW CHARACTERISTIC (%) × SECOND NOZZLE ROW USAGE RATE
EXPECTED INK AMOUNT (%) = STANDARD INK AMOUNT (ng) × EXPECTED CHARACTERISTIC (%)

FIG. 20

| FIRST NOZZLE ROW USAGE RATE | SECOND NOZZLE ROW USAGE RATE | INCREASE/DECREASE NUMBER (WHEN COUNT NUMBER IS 10,000) | | |
|---|---|---|---|---|
| | | SMALL DOT (5ng) | MEDIUM DOT (10ng) | LARGE DOT (20ng) |
| 1 | 0 | 526 | −566 | 309 |
| 0.9 | 0.1 | 438 | −421 | 225 |
| 0.8 | 0.2 | 352 | −272 | 142 |
| 0.7 | 0.3 | 267 | −119 | 60 |
| 0.6 | 0.4 | 183 | 40 | −20 |
| 0.5 | 0.5 | 101 | 204 | −99 |

NEGATIVE VALUES ARE FOR DELETION,
POSITIVE VALUES ARE FOR ADDITION

FIG. 21

| DOT SIZE | EXPECTED INK AMOUNT | VARIATION DIRECTION |
|---|---|---|
| LARGE DOT | SMALLER THAN STANDARD | ADD LARGE DOT |
| | LARGER THAN STANDARD | CHANGE LARGE → MEDIUM |
| MEDIUM DOT | SMALLER THAN STANDARD | CHANGE MEDIUM → LARGE |
| | LARGER THAN STANDARD | CHANGE MEDIUM → SMALL |
| SMALL DOT | SMALLER THAN STANDARD | CHANGE SMALL → MEDIUM |
| | LARGER THAN STANDARD | DELETE SMALL DOT |

FIG. 26

| VARIATION DIRECTION | INK VARIATION AMOUNT |
|---|---|
| ADD LARGE DOT | EXPECTED INK AMOUNT OF LARGE DOT |
| CHANGE LARGE → MEDIUM | EXPECTED INK AMOUNT OF LARGE DOT - EXPECTED INK AMOUNT MEDIUM DOT |
| CHANGE MEDIUM → LARGE | |
| CHANGE MEDIUM → SMALL | EXPECTED INK AMOUNT MEDIUM DOT - EXPECTED INK AMOUNT SMALL DOT |
| CHANGE SMALL → MEDIUM | |
| DELETE SMALL DOT | EXPECTED INK AMOUNT OF SMALL DOT |

FIG. 27

| DOT SIZE | COUNT VALUE | EXPECTED INK AMOUNT | VARIATION DIRECTION | INK VARIATION AMOUNT | NUMBER OF DOTS TO BE VARIED |
|---|---|---|---|---|---|
| LARGE | 10000 | 19.88 | ADD LARGE | 19.88 | 60 |
| MEDIUM | 10000 | 10.12 | MEDIUM → SMALL | 5.25 | 229 |
| SMALL | 10000 | 4.87 | SMALL → MEDIUM | 5.25 | 248 |

FIG. 28

LIQUID EJECTING METHOD, LIQUID EJECTING APPARATUS, AND STORAGE MEDIUM HAVING PROGRAM STORED THEREON

CROSS-REFERENCE TO RELATED APPLICATIONS

The present application claims priority upon Japanese Patent Application No. 2007-332722 filed on Dec. 25, 2007, which is herein incorporated by reference.

BACKGROUND

1. Technical Field

The present invention relates to liquid ejecting methods, liquid ejecting apparatuses, and storage media having a program stored thereon.

2. Related Art

Inkjet printers are known as liquid ejecting apparatuses that eject liquid. In inkjet printers, by alternately repeating a transport operation, in which a medium such as paper or cloth is transported in a transport direction, and a dot forming operation, in which a head constituted by a plurality of nozzles is moved in a movement direction while ink is ejected from the nozzles, rows of dots that line up in the movement direction (dot rows) are formed lined up in the transport direction, thereby forming an image on the medium.

In an inkjet printer such as this, it is desirable to increase the number of nozzles so as to increase printing speeds. However, it is difficult to form a multitude of nozzles having a predetermined pitch with excellent accuracy and, moreover, this involves greater manufacturing costs.

Accordingly, attempts are being made to increase the number of nozzles by arranging a plurality of nozzle rows (see JP-A-10-323978).

Each nozzle row has its own characteristics. For example, a certain nozzle row may eject a large amount of ink, while another nozzle row may eject a small amount of ink. For this reason, when usage rates of nozzle rows vary according to locations on the medium, differences in nozzle row characteristics may become conspicuous. For example, if, while the nozzle rows of two heads are used evenly to print in a certain region on the medium, only the nozzle rows of one of the heads are used in another region, there may be differences in picture quality between these regions. And when two regions having different levels of picture quality are adjacent to each other, a difference in picture quality becomes undesirably conspicuous.

SUMMARY

An object of the invention is to suppress characteristic differences of nozzle rows from becoming conspicuous when ejecting a liquid using a plurality of nozzle rows.

A primary aspect of the invention for achieving the above-described object is: a liquid ejecting method, comprising:

varying dots that are to constitute a dot row that is to be formed with a first nozzle row and a second nozzle row, according to a usage rate of each of the first and second nozzle rows when forming that dot row, the first nozzle row including a plurality of first nozzles lined up in a transport direction, the second nozzle row including a plurality of second nozzles in the transport direction, the first nozzles of the first nozzle row forming dots on a medium by ejecting liquid while moving in a movement direction, the second nozzles of the second nozzle row forming dots on the medium by ejecting liquid while moving in the movement direction, the dot row that has been formed on the medium being composed of a plurality of the dots to be lined up on the medium in the movement direction; and forming a plurality of the dot rows in the transport direction by alternately repeating a transport operation of transporting the medium in the transport direction and a dot forming operation of forming a dot on the medium by ejecting liquid from the first nozzles and the second nozzles while the first and second nozzles moving in the movement direction, at least one of the dot rows that have been formed by the first and second nozzles being composed of the dots that are varied according to the usage rate of each of the first nozzle row and the second nozzle row.

Other features of the invention will be made clear by reading the description of the present specification with reference to the accompanying drawings.

BRIEF DESCRIPTION OF THE DRAWINGS

FIG. 6B is a diagram in which FIG. 6A is expressed using a different notation method.

FIG. 12A (upper left) is a graph of nozzle usage rates in the first dot forming method. FIG. 12B (lower left) is a graph of nozzle usage rates in the second dot forming method. FIG. 12C (upper right) is a graph of nozzle usage rates in the third dot forming method. FIG. 12D (lower right) is a graph of nozzle usage rates in the fourth dot forming method.

FIG. 15 is an explanatory diagram of color irregularity correction values.

FIG. 19 is an explanatory diagram of color irregularity correction values obtained by a printer driver.

FIG. 20 is an explanatory diagram of expected ink amounts.

FIG. 21 is an explanatory diagram of dot numbers to be deleted or added.

FIG. 26 is a comparative table of dot size variation directions.

FIG. 27 is an explanatory diagram of changed ink amounts.

FIG. 28 shows an example of calculating the number of dots to be varied.

DESCRIPTION OF EXEMPLARY EMBODIMENTS

Figure 1:
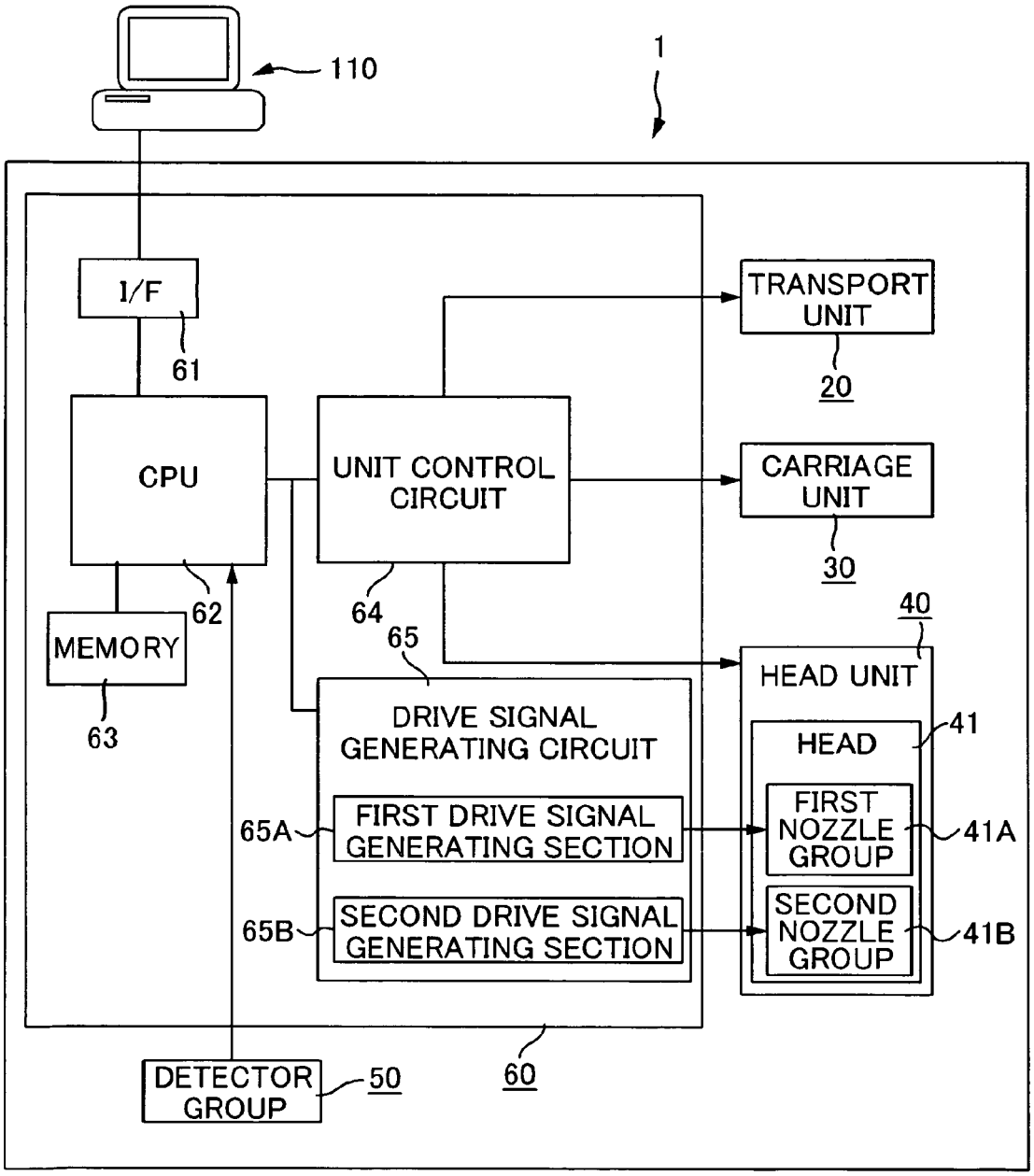
FIG. 1 is a block diagram of an overall configuration of a printer 1.

At least the following matters will be made clear by the explanation in the present specification and the description of the accompanying drawings.

A liquid ejecting method will be made clear that includes: varying dots that are to constitute a dot row that is to be formed with a first nozzle row and a second nozzle row, according to a usage rate of each of the first and second nozzle rows when forming that dot row, the first nozzle row including a plurality of first nozzles lined up in a transport direction, the second nozzle row including a plurality of second nozzles in the transport direction, the first nozzles of the first nozzle row forming dots on a medium by ejecting liquid while moving in a movement direction, the second nozzles of the second nozzle row forming dots on the medium by ejecting liquid while moving in the movement direction, the dot row that has been formed on the medium being composed of a plurality of the dots to be lined up on the medium in the movement direction; and forming a plurality of the dot rows in the transport direction by alternately repeating a transport operation of transporting the medium in the transport direction and a dot forming operation of forming a dot on the medium by ejecting liquid from the first nozzles and the second nozzles while the first and second nozzles moving in the movement direction, at least one of the dot rows that have been formed by the first and second nozzles being composed of the dots that are varied according to the usage rate of each of the first nozzle row and the second nozzle row. With this liquid ejecting method, it is possible to suppress nozzle row characteristic differences from becoming conspicuous.

It should be noted that in the embodiments to be described, nozzles of a first nozzle row 42A correspond to the "first nozzles" and nozzles of a second nozzle row 42B correspond to the "second nozzles". Furthermore, deleting or adding dots according to a first embodiment to be described, and varying dot sizes according to a second embodiment to be described, correspond to "varying dots that constitute the dot row".

It is preferable that, in the case of varying the dots that are to constitute the dot row, a dot is added to a position neighboring a position of the dots that are to constitute the dot row. In this way, dots can be added at desirable positions without impairing the picture quality.

It is preferable that, in the case where a plurality of dots are to be added in varying the dots that are to constitute the dot row, a plurality of positions in which dots are to be added are determined, based on a position that is randomly selected among positions of the plurality of dots that are to constitute the dot row. In this way, more dots are added to locations where dots are concentrated, thereby not impairing the darkness/lightness of the image before correction.

It is preferable that the first nozzle row and the second nozzle row can respectively form a plurality of sizes of dots, and that in varying the dots that are to constitute the dot row, a size of a dot to be formed is varied. In this way, the amount density change in the pixels is reduced, thereby not impairing the darkness/lightness of the image before correction.

It is preferable that first correction values that indicate a liquid amount to be ejected from the first nozzles and second correction values that indicate a liquid amount to be ejected from the second nozzles are set in advance; in forming a dot row using the first nozzle row and the second nozzle row, an expected value of a liquid amount to be ejected in order to form a dot that is to constitute that dot row is calculated based on a usage rate of each of the first and second nozzle rows when forming that dot row, a usage rate of the first nozzle row, and the first and second correction values; and the number of the dots that are to constitute that dot row is varied based on the expected values. In this way, it is possible to suppress increases/decreases in the liquid amounts ejected when forming the dot row due to characteristic differences of the nozzle rows.

Preferably, the liquid ejecting method further includes a first process of alternately repeating the dot forming operation and the transport operation of transporting the medium by a first transport amount, a second process of alternately repeating the dot forming operation and the transport operation of transporting the medium by a second transport amount that is shorter than the first transport amount, and a third process of alternately repeating the dot forming operation and the transport operation of transporting the medium in a first direction by a third transport amount that is shorter than the first transport amount and longer than the second transport amount, the third process being carried out between the first process and the second process, in a dot row of a first region on the medium, a ratio of the number of dots formed by the first nozzles with respect to the number of dots formed by the second nozzles is a predetermined ratio, in a dot row of a second region on the medium, no dot is formed by the second nozzles, and the dot row is constituted by dots formed by the first nozzles, and a third region between the first region and the second region includes a dot row in which a ratio of the number of dots formed by the first nozzles with respect to the number of dots formed by the second nozzles is higher than the predetermined ratio. In this way, the third region can be increased and the difference in picture quality between the first region and the second region tends not to become conspicuous.

It should be noted that in the embodiments to be described, ordinary processing corresponds to the "first process", the upper end processing or lower end processing corresponds to the "second process" and transition processing corresponds to the "third process". Furthermore, the ordinary region corresponds to the "first region", the upper end region or the lower end region corresponds to the "second region", and the transition region corresponds to the "third region".

A liquid ejecting apparatus will also be made clear that includes: a transport section for transporting a medium in a transport direction; a first nozzle row including a plurality of first nozzles lined up in the transport direction; a second nozzle row including a plurality of second nozzles in the transport direction; and a controller that varies dots that are to constitute a dot row that is to be formed with the first nozzle row and the second nozzle row, according to a usage rate of each of the first and second nozzle rows when forming that dot row, the first nozzles of the first nozzle row forming dots on a medium by ejecting liquid while moving in a movement direction, the second nozzles of the second nozzle row forming dots on the medium by ejecting liquid while moving in the movement direction, the dot row that has been formed on the medium being composed of a plurality of the dots to be lined up on the medium in the movement direction; and that forms a plurality of the dot rows in the transport direction by alternately repeating a transport operation of transporting the medium in the transport direction and a dot forming operation of forming a dot on the medium by ejecting liquid from the first nozzles and the second nozzles while the first and second nozzles moving in the movement direction, at least one of the dot rows that have been formed by the first and second nozzles being composed of the dots that are varied according to the usage rate of each of the first nozzle row and the second nozzle row.

A storage medium having a program stored thereon will be made clear, the program including:

enabling a liquid ejecting apparatus that includes a transport section for transporting a medium in a transport direction, a first nozzle row including a plurality of first nozzles lined up in the transport direction, and a second nozzle row including a plurality of second nozzles in the transport direction, to realize a function to vary dots that are to constitute a dot row that is to be formed with the first nozzle row and the second nozzle row, according to a usage rate of each of the first and second nozzle rows when forming that dot row, the first nozzles of the first nozzle row forming dots on a medium by ejecting liquid while moving in a movement direction, the second nozzles of the second nozzle row forming dots on the medium by ejecting liquid while moving in the movement direction, the dot row that has been formed on the medium being composed of a plurality of the dots to be lined up on the medium in the movement direction, and a function to forming a plurality of the dot rows in the transport direction by alternately repeating a transport operation of transporting the medium in the transport direction and a dot forming operation of forming a dot on the medium by ejecting liquid from the first nozzles and the second nozzles while the first and second nozzles moving in the movement direction, at least one of the dot rows that have been formed by the first and second nozzles being composed of the dots that are varied according to the usage rate of each of the first nozzle row and the second nozzle row.

Configuration of Printer

Regarding the Configuration of the Inkjet Printer

Figure 2A:
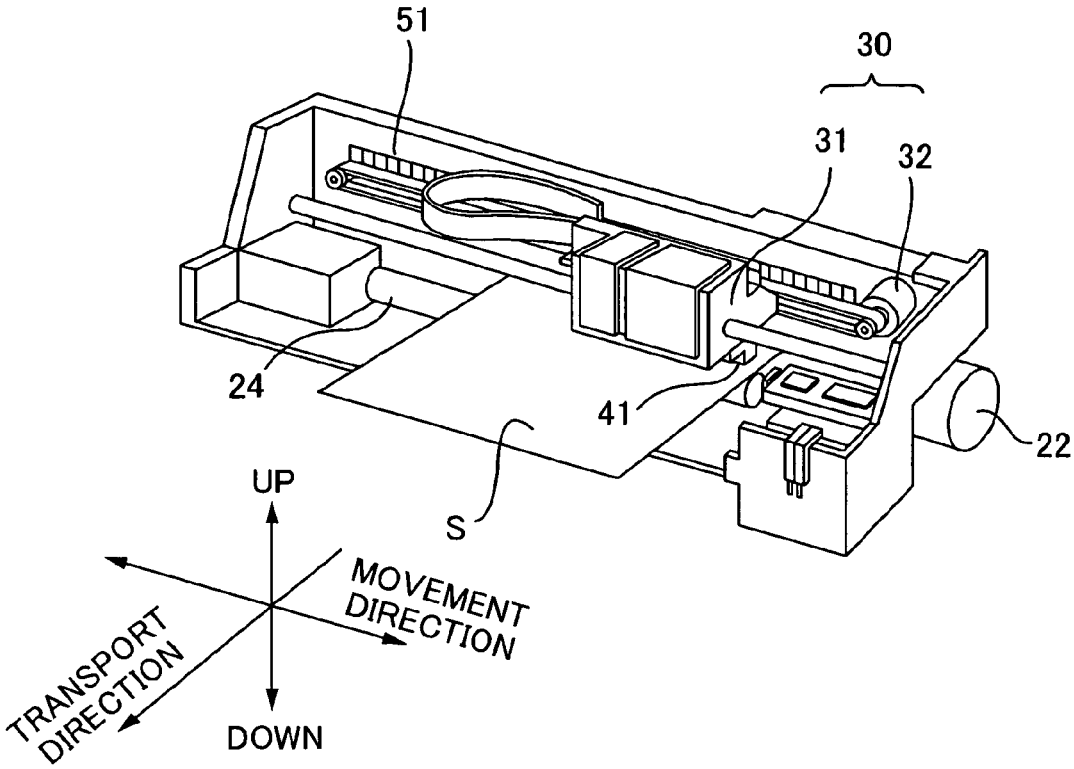
FIG. 2A is a schematic view of the overall configuration of the printer 1.
Figure 2B:
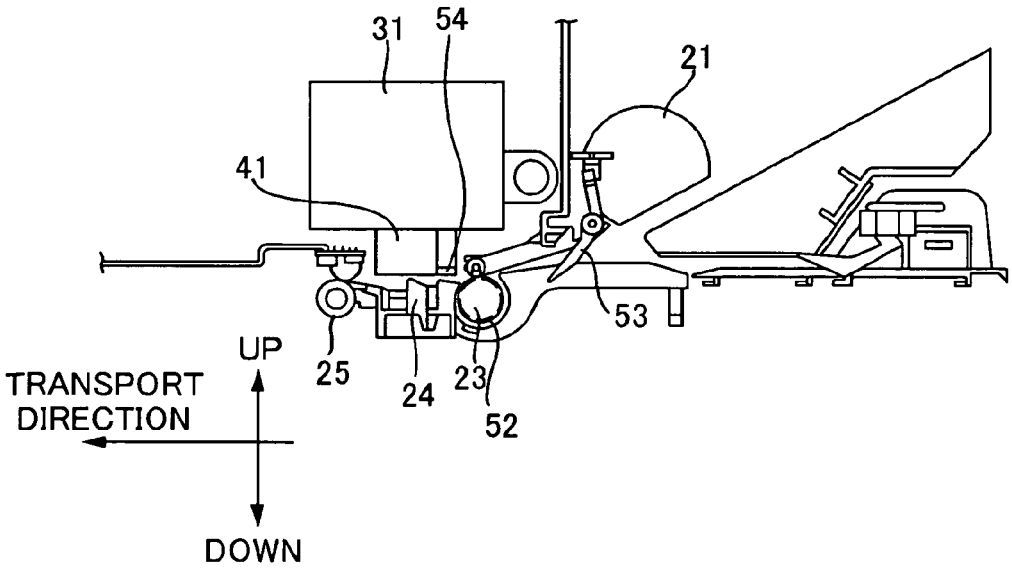
FIG. 2B is a lateral cross-sectional view of the overall configuration of the printer 1.

FIG. 1 is a block diagram of an overall configuration of a printer 1. FIG. 2A is a schematic view of the overall configuration of the printer 1. And FIG. 2B is a lateral cross-sectional view of the overall configuration of the printer 1. Hereinafter, the basic configuration of the printer is described.

The printer 1 includes a transport unit 20, a carriage unit 30, a head unit 40, a detector group 50, and a controller 60. The printer 1, upon having received print data from a computer 110, which is an external device, controls various units (the transport unit 20, the carriage unit 30, and the head unit 40) using the controller 60. The controller 60 controls the units based on the print data received from the computer 110 to form an image on paper. The detector group 50 monitors conditions within the printer 1, and outputs detection results to the controller 60. The controller 60 controls the units based on the detection results outputted from the detector group 50.

The transport unit 20 is for transporting a medium (such as paper S) in a predetermined direction (hereinafter referred to as transport direction). The transport unit 20 includes a paper feed roller 21, a transport motor 22 (also referred to as PF motor), a transport roller 23, a platen 24, and a discharge roller 25. The paper feed roller 21 is a roller for feeding paper that has been inserted into a paper insert opening into the printer. The transport roller 23 is a roller for transporting the paper S that has been fed by the paper feed roller 21 up to a printable region, and is driven by the transport motor 22. The platen 24 supports the paper S during printing. The discharge roller 25 is a roller for discharging the paper S out of the printer, and is provided on the downstream side, with respect to the transport direction, of the printable region.

The carriage unit 30 is for causing the head to move (also referred to as "scan") in a predetermined direction (hereinafter, referred to as a movement direction). The carriage unit 30 includes a carriage 31 and a carriage motor 32 (also referred to as a CR motor). The carriage 31 can move in a reciprocating manner along the movement direction, and is driven by the carriage motor 32. Furthermore, the carriage 31 detachably retains an ink cartridge that contains ink.

The head unit 40 is for ejecting ink onto paper. The head unit 40 is provided with a head 41 including a plurality of nozzles. The head 41 is provided on the carriage 31 so that when the carriage 31 moves in the movement direction, the head 41 also moves in the movement direction. Then, dot lines (raster lines) are formed on the paper in the movement direction as a result of the head 41 intermittently ejecting ink while moving in the movement direction.

It should be noted that a first nozzle group 41A and a second nozzle group 41B are provided in the head 41. Description is given later regarding the configuration of these two nozzles groups.

The detector group 50 includes a linear encoder 51, a rotary encoder 52, a paper detection sensor 53, and an optical sensor 54, for example. The linear encoder 51 is for detecting the position of the carriage 31 in the movement direction. The rotary encoder 52 is for detecting a rotation amount of the transport roller 23. The paper detection sensor 53 detects the position of a leading edge of the paper that is being fed. The optical sensor 54 detects whether or not the paper is present using a light-emitting section and a light-receiving section that are installed in the carriage 31. The optical sensor 54 can detect a width of the paper by detecting a position of an end portion of the paper while being moved by the carriage 31. Depending on the circumstances, the optical sensor 54 can also detect the leading edge of the paper (the end portion on the downstream side with respect to the transport direction; also called the upper end) and the trailing edge of the paper (the end portion on the upstream side with respect to the transport direction; also called the lower end).

The controller 60 is a control unit (controller) for controlling the printer. The controller 60 includes an interface section 61, a CPU 62, a memory 63, and a unit control circuit 64. The interface section 61 exchanges data between the computer 110, which is an external device, and the printer 1. The CPU 62 is a computer processing device for carrying out overall control of the printer. The memory 63 is for reserving a working region and a region for storing the programs for the CPU 62, for instance, and has a memory device such as a RAM or an EEPROM. The CPU 62 controls each unit via the unit control circuit 64 according to a program stored in the memory 63.

Further still, a drive signal generating circuit 65 is provided in the controller 60. The drive signal generation circuit 65 is provided with a first drive signal generating section 65A and a second drive signal generating section 65B. The first drive signal generating section 65A generates a first drive signal for driving piezo elements of the first nozzle group 41A. The second drive signal generating section 65B generates a second drive signal for driving piezo elements of the second nozzle group 41B. Each of the drive signal generating sections generates a drive signal for odd number pixels when forming a dot in an odd number pixel (described later) and generates a drive signal for even number pixels when forming a dot in an even number pixel (described later). The drive signal generating sections are independent from each other and, for example, when the first drive signal generating section 65A is generating a drive signal for odd number pixels, the second drive signal generating section 65B also can be generating a drive signal for odd number pixels or can be generating a drive signal for even number pixels.

When carrying out printing, the controller 60 alternately repeats the dot forming operation, in which ink is ejected from the head 41 that is being moved in the movement direction, and the transport operation, in which the paper is transported in the transport direction, thereby printing on paper an image constituted by a multitude of dots. It should be noted that the dot forming operation may be referred to as a "pass" and an n-th pass may be referred to as "pass n".

Configuration of the Head 41

Regarding the Configuration

Figure 3:
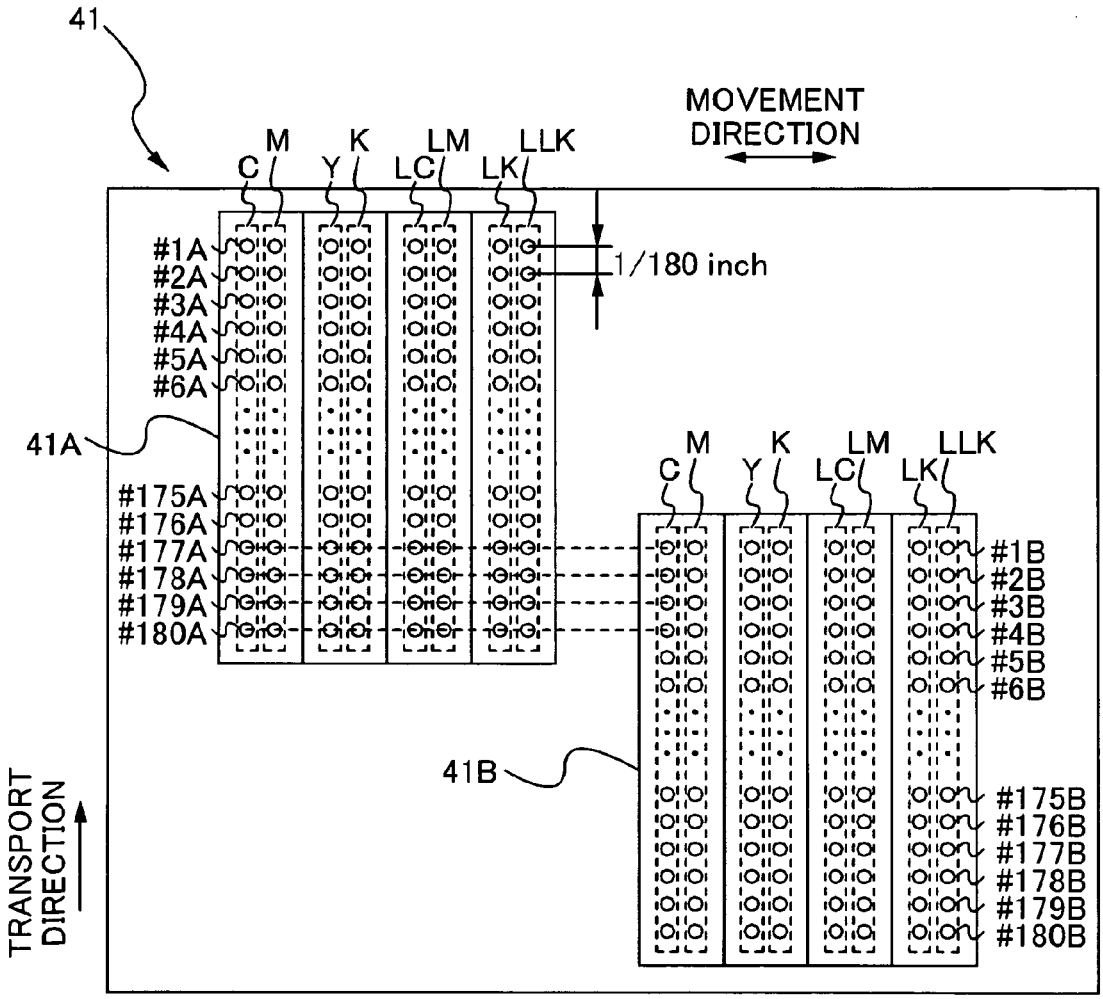
FIG. 3 is an explanatory diagram showing an arrangement of nozzles.

FIG. 3 is an explanatory diagram showing an arrangement of nozzles. Two nozzle groups (the first nozzle group 41A and the second nozzle group 41B) are provided on the lower surface of the head 41. Eight nozzle rows are provided in each nozzle group. The eight nozzle rows eject ink of dark cyan (C), dark magenta (M), yellow (Y), dark black (K), light cyan (LC), light magenta (LM), light black (LK), and very light black (LLK) respectively.

In each nozzle row there are 180 nozzles lined up in the transport direction arranged having a nozzle pitch of 180 dpi. Also, the nozzles in each of the nozzle rows are assigned numbers that are smaller toward the downstream side of the transport direction. Each nozzle is provided with a piezo element (not shown) as a drive element for causing an ink droplet to be ejected from the nozzle.

The first nozzle group 41A is provided on the downstream side in the transport direction from the second nozzle group 41B. Furthermore, the first nozzle group 41A and the second nozzle group 41B are arranged so that transport direction positions of four of their nozzles overlap. For example, the transport direction position of a nozzle #177A of the first nozzle group 41A is in the same transport direction position as a nozzle #1B of the second nozzle group 41B. In this way, when the nozzle #177A of the first nozzle group 41A is capable of forming a dot for a certain pixel in a certain dot forming operation, the nozzle #1B of the second nozzle group 41B is also capable of forming a dot for that pixel.

Methods for Forming Dots

Regarding Methods for Notating Nozzle. Rows

First, before describing methods for forming dots, description is given regarding methods for notating nozzle rows and nozzles.

Figure 4:
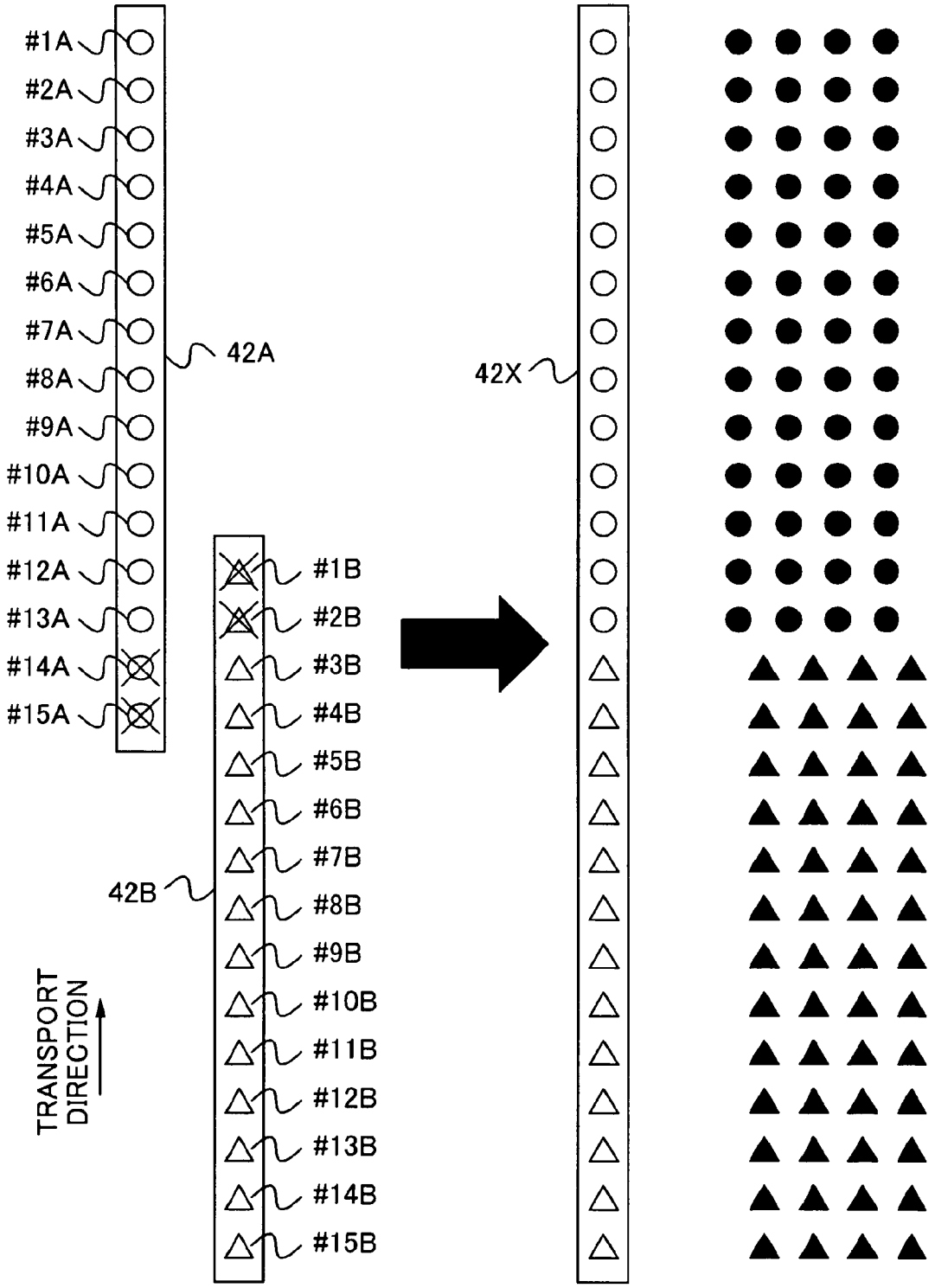
FIG. 4 is an explanatory diagram of a virtual nozzle row 42X.

FIG. 4 is an explanatory diagram of a virtual nozzle row 42X.

The dark black nozzle row of the first nozzle group 41A and the dark black nozzle row of the second nozzle group 41B are shown on the left side in FIG. 4. In the following description, the dark black nozzle row of the first nozzle group 41A is referred to as "first nozzle row 42A" and the dark black nozzle row of the second nozzle group 41B is referred to as "second nozzle row 42B". It should be noted that the number of nozzles in each nozzle row is set at 15 nozzles in order to simplify description.

Four nozzles on the transport direction upstream side of the first nozzle row 42A (nozzle #12A to nozzle #15A) and four nozzles on the transport direction downstream side of the second nozzle row 42B (nozzle #1B to nozzle #4B) have transport direction positions that overlap. In the following description, these four nozzles of each of the nozzle rows are referred to as "overlapping nozzles".

Each of the nozzles of the first nozzle row 42A is indicated by circles and each of the nozzles of the second nozzle row 42B are indicated by triangles. Furthermore, cross marks indicate nozzles that do not eject ink (that is, nozzles that do not form a dot).

Here, of the overlapping nozzles of the first nozzle row 42A, ink is ejected from the nozzle #12A and nozzle #13A, and ink is not ejected from the nozzle #14A and nozzle #15A. Furthermore, here, of the overlapping nozzles of the second nozzle row 42B, ink is not ejected from the nozzle #1B and nozzle #2B, but the nozzle #3B and nozzle #4B do eject ink.

In a case such as this, description can be given of the two nozzle rows as a single virtual nozzle row 42X as shown in a central area of FIG. 4. In the following description, instead of portraying the two nozzle rows separately, a manner of forming dots is described using the single virtual nozzle row 42X.

It should be noted in regard to the virtual nozzle row 42X that, as shown on the right side of FIG. 4, the triangle mark nozzles can form dots in even number pixels even when the circle mark nozzles form dots in odd number pixels. Of course, the triangle mark nozzles are also capable of forming dots in odd number pixels when the circle mark nozzles form dots in odd number pixels.

Reference: Ordinary Processing

Figure 5:
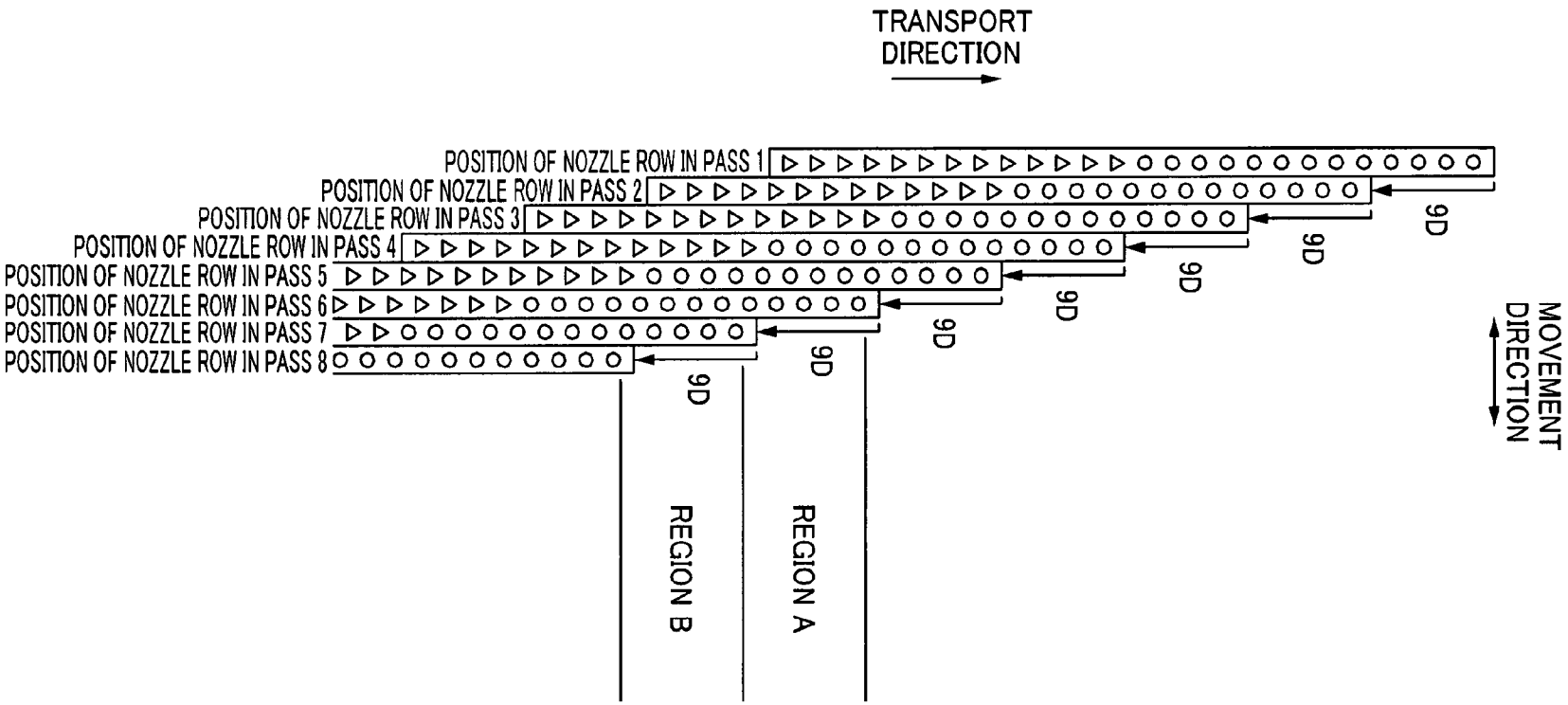
FIG. 5 is an explanatory diagram of ordinary processing.

FIG. 5 is an explanatory diagram of ordinary processing. Ordinary processing is the processing (dot forming operations and transport operations) carried out when printing a central area of the paper. The controller 60 executes ordinary processing, which is described hereinafter, by controlling the various units.

FIG. 5 shows a relative positional relationship of the virtual nozzle row 42X with respect to the paper during each dot forming operation. In FIG. 5, the virtual nozzle row 42X is depicted as though moving with respect to the paper but in fact it is the paper that moves in the transport direction. As shown in FIG. 5, in ordinary processing, the paper is transported by a transport amount 9D of nine dot portion in the transport operation carried out between the passes.

In region A (a region on the paper) in FIG. 5, dots are formed by passes 1 to 6. In region B, dots are formed by passes 2 to 7.

In odd number passes, each of the nozzles are positioned at even number (or odd number) raster lines. After an odd number pass, an even number pass is carried out after the paper has been transported by the transport amount 9D of nine dot portion, and therefore in an even number pass, each of the nozzles are positioned at odd number (or even number) raster lines. In this way, the position of each of the nozzles alternates in each pass to positions of odd number or even number raster lines.

Figure 6A:
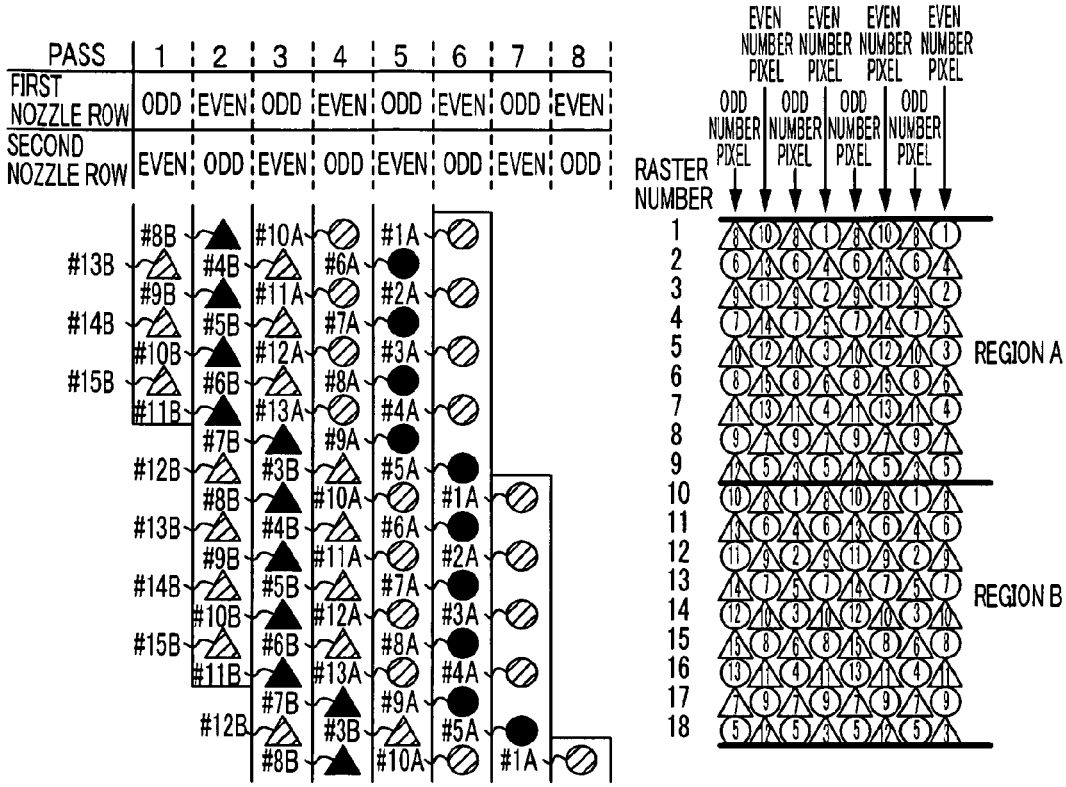
FIG. 6A is an explanatory diagram of dot forming in a region A and region B of FIG. 5.

FIG. 6A is an explanatory diagram of dot forming in the region A and region B of FIG. 5.

The left side of FIG. 6A shows relative positions of the nozzles in each pass. Darkly filled nozzles form a dot every one in two pixels in that pass. For example, the nozzle #8B in pass 2 forms a dot every one in two pixels. Diagonally hatched nozzles form a dot every one in four pixels. For example, the nozzle #10A in pass 4 forms a dot every one in four pixels.

Diagonally hatched nozzles form only half the dots compared to darkly filled nozzles. These diagonally hatched nozzles will be referred to here as "POL nozzles".

Four nozzles on the transport direction upstream side of the first nozzle row 42A in a certain pass (nozzle #10A to nozzle #13A) and four nozzles on the transport direction downstream side of the first nozzle row 42A (nozzle #1A to nozzle #4A) after the transport operation has been carried out two times from the certain pass have transport direction positions that overlap. These nozzles are POL nozzles. For example, the nozzles #10A to #13A of pass 4 and nozzles #1A to #4A of pass 6 have transport direction positions that overlap, and therefore are POL nozzles.

Similarly, four nozzles on the transport direction upstream side of the second nozzle row 42B in a certain pass (nozzle #12B to nozzle #15B) and four nozzles on the transport direction downstream side of the second nozzle row 42B (nozzle #3B to nozzle #6B) after the transport operation has been carried out two times from the certain pass have transport direction positions that overlap. These nozzles are POL nozzles. For example, the nozzles #12B to #15B of pass 2 and nozzles #3B to #6B of pass 4 have transport direction positions that overlap, and therefore are POL nozzles.

The right side of FIG. 6A shows the nozzles that form the dots in each pixel. For example, the first raster line (the raster line having the raster number 1) is constituted by dots formed by the nozzle #8B in odd number pixels, and dots formed by the nozzles #10A and #1A in even number pixels. It should be noted that in order to simplify description here, each raster line is constituted by only eight dots.

The upper left side of FIG. 6A shows positions of the dots formed by each of the nozzle rows. For example, in pass 1, nozzles of the first nozzle row 42A (nozzles #1A to #13A) form dots in odd number pixels, and nozzles of the second nozzle row 42B (nozzles #3B to #15B) form dots in even number pixels.

Each raster line is constituted by dots that are formed by two or three nozzles. In other words, two or three nozzles are associated with each raster line. For example, the nozzle #8B in pass 2, nozzle #10A in pass 4, and nozzle #1A in pass 6 are associated with the first raster line. Furthermore, each raster line is constituted by dots formed by at least one nozzle of the first nozzle row 42A and dots formed by at least one nozzle of the second nozzle row 42B. In other words, at least one nozzle of the first nozzle row 42A and at least one nozzle of the second nozzle row 42B are associated with each raster line.

In the case where only one nozzle is associated with odd number pixels or even number pixels of a certain raster line, that nozzle forms a dot every one in two pixels. For example, only the single nozzle #8B is associated (no other nozzle is associated) with odd number pixels of the first raster line. Thus, the nozzle #8B forms a dot every one in two pixels.

On the other hand, in the case where two nozzles are associated with odd number pixels or even number pixels of a certain raster line, those two nozzles form a dot every one in four pixels respectively (they are POL nozzles). For example, the nozzle #10A and nozzle #1A are associated with even number pixels in the first raster line. Thus, the nozzle #10A and nozzle #1A form a dot every one in four pixels respectively (they are POL nozzles).

In any particular pass in ordinary processing, the positions (movement direction positions) where dots are formed by the first nozzle row 42A and the positions where dots are formed by the second nozzle row 42B are different. Specifically, when the first nozzle row 42A forms dots at odd number pixels, the second nozzle row 42B forms dots at even number pixels. Conversely, when the first nozzle row 42A forms dots at even number pixels, the second nozzle row 42B forms dots at odd number pixels. This manner of dot forming is possible since the aforementioned first drive signal generating section 65A and second drive signal generating section 65B can generate drive signals independently from each other.

Furthermore, in ordinary processing, the positions where dots are formed by each nozzle row are different when comparing a certain pass and a next pass. For example, in the case where the first nozzle row 42A forms dots at odd number pixels and the second nozzle row 42B forms dots at even number pixels in a certain pass, the first nozzle row 42A will form dots at even number pixels and the second nozzle row 42B will form dots at odd number pixels in the next pass.

By forming dots in this manner, dots are formed in a zigzag lattice shape by one nozzle row, then, so as to fill in spaces between dots in this zigzag lattice, dots are formed by another nozzle row in a zigzag lattice shape. In observing the right side of FIG. 6A, circle mark dots formed by the first nozzle row 42A are in a zigzag lattice shape, and triangle mark dots formed by the second nozzle row 42B are in also a zigzag lattice shape. It should be noted that when proceeding with this sequence of dot forming, after dots are formed in the zigzag lattice shape by the second nozzle row 42B, dots are formed by the first nozzle row 42A so as to fill in those spaces.

When a raster line has been formed in ordinary processing, half the dots of that raster line are formed by the first nozzle row 42A and the remaining half of the dots are formed by the second nozzle row 42B. In other words, the usage rate of each nozzle row when forming these raster lines is 50% for the first nozzle row 42A and 50% also for the second nozzle row 42B.

Dots are formed in the region A by passes 1 to 6 and dots are formed in the region B by passes 2 to 7, and therefore the passes are staggered by one time between the region A and region B. Since the passes are staggered by one time, even though there are nozzles associated with each raster line common in each region, the positions of dots (movement direction position) to be formed by each nozzle vary for odd number pixels and even number pixels. For example, the nozzle #8B forms dots at odd number pixels in pass 2 for the first raster line, but the nozzle #8B forms dots at even number pixels in pass 3 for a tenth raster line.

It should be noted that, although not shown in the diagram here, the 19th to 27th raster lines, which are positioned on the transport direction upstream side from the region B, are formed by dots in passes 3 to 8 in a substantially equivalent manner as in the region A. For example, the 19th raster line is associated with the nozzle #8B, nozzle #10A, and nozzle #1A, and the nozzle #8B forms dots at odd number pixels of the 19th raster line. Furthermore, the 28th to 36th raster lines, which are positioned on the transport direction upstream side from the 19th to 27th raster lines, are formed by dots in passes 4 to 9 in a substantially equivalent manner as in the region B.

In this way, when ordinary processing is carried out continuously, equivalent dot forming is carried out repetitively in the region A and region B.

Figure 6B:
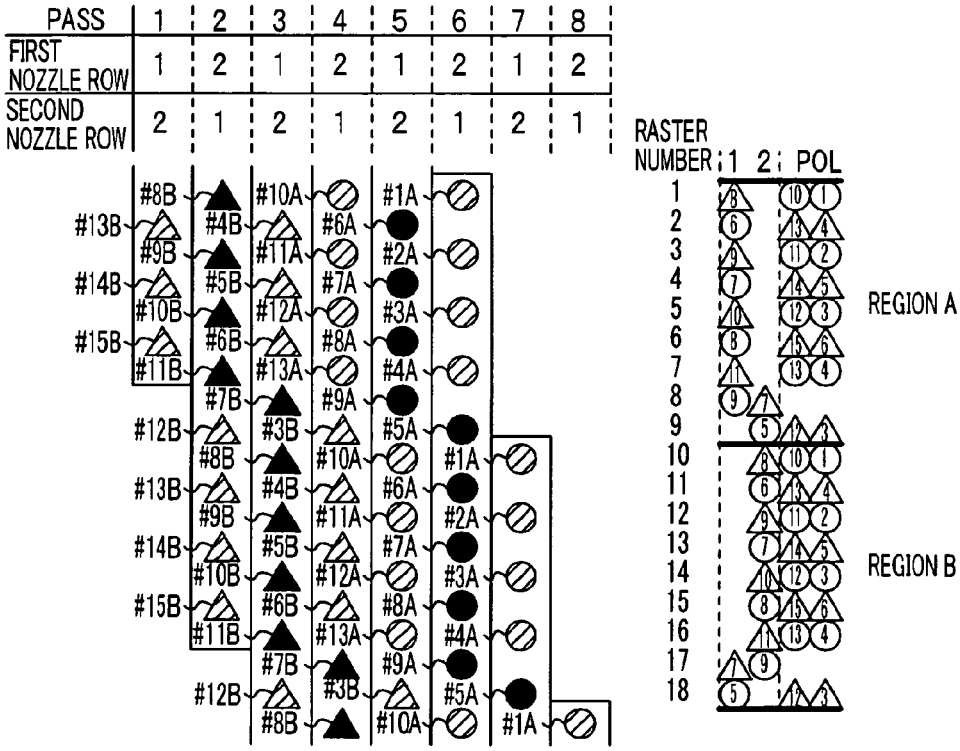

FIG. 6B is a diagram in which FIG. 6A is expressed using a different notation method.

In the notation on the upper left of FIG. 6B, odd numbers are indicated as "1" and even numbers are indicated as "2". For example, it is indicated that in pass 1, nozzles of the first nozzle row 42A (nozzles #1A to #13A) form dots at odd number pixels, and nozzles of the second nozzle row 42B (nozzles #3B to #15B) form dots at even number pixels.

In the notation on the right side also of FIG. 6B, odd number pixels are indicated as "1" and even number pixels are indicated as "2". And in the case where a single nozzle is associated with odd number pixels, a symbol indicating that nozzle is shown below the "1" that indicates odd number pixels. For example, it is shown that the nozzle #8B is associated with odd number pixels of the first raster line. Furthermore, in the case where a single nozzle is associated with even number pixels, a symbol indicating that nozzle is shown below the "2" that indicates even number pixels. For example, it is shown that the nozzle #7B is associated with even number pixels of the eighth raster line. In other words it should be noted that if a symbol indicating a nozzle is shown below the "1" that indicates odd number pixels, then that nozzle forms a dot everyone in two pixels. Similarly, if a symbol indicating a nozzle is shown below the "2" that indicates even number pixels, then that nozzle forms a dot every one in two pixels.

Furthermore, in the case where two nozzles are associated with odd number pixels or even number pixels, the symbols of those two nozzles are shown below the characters "POL" in FIG. 6B since these nozzles are POL nozzles. For example, the nozzle #10A and nozzle #1A are associated with even number pixels of the first raster line, and symbols indicating the nozzle #10A and nozzle #1A are listed below the characters "POL" on the right side in FIG. 6B since these nozzles are POL nozzles. In other words it should be noted that if a symbols indicating two nozzles are shown below the characters "POL", then those nozzles form a dot every one in four pixels.

When symbols indicating two nozzles are shown below the characters "POL", symbols indicating the nozzles are not shown below the "1" that indicates odd number pixels or the "2" that indicates even number pixels. If there is no symbol indicating a nozzle below the "1" that indicates odd number pixels, then POL nozzles form dots at odd number pixels. For example, for the ninth raster line, the nozzle #12B and nozzle #3B, which are POL nozzles, form dots at the odd number pixels. Furthermore, when there is no symbol indicating a nozzle below the "2" that indicates even number pixels, then POL nozzles form dots at even number pixels. For example, for the first raster line, the nozzle #10A and nozzle #1A, which are POL nozzles, form dots at the even number pixels.

With the foregoing description and by observing the description on the right side in FIG. 6B, it is understandable that dots are formed as shown on the right side in FIG. 6A. Accordingly, in the following description, the notation method of FIG. 6B is used to describe how dots are formed. Furthermore, for reasons of space in the diagrams, the numerals inside the circle marks and triangle marks on the right side of FIG. 6B will also be omitted.

First Dot Forming Method

Next, description is given regarding how dots are formed by carrying out ordinary processing after carrying out upper end processing for printing the upper end of the paper.

Figure 7:
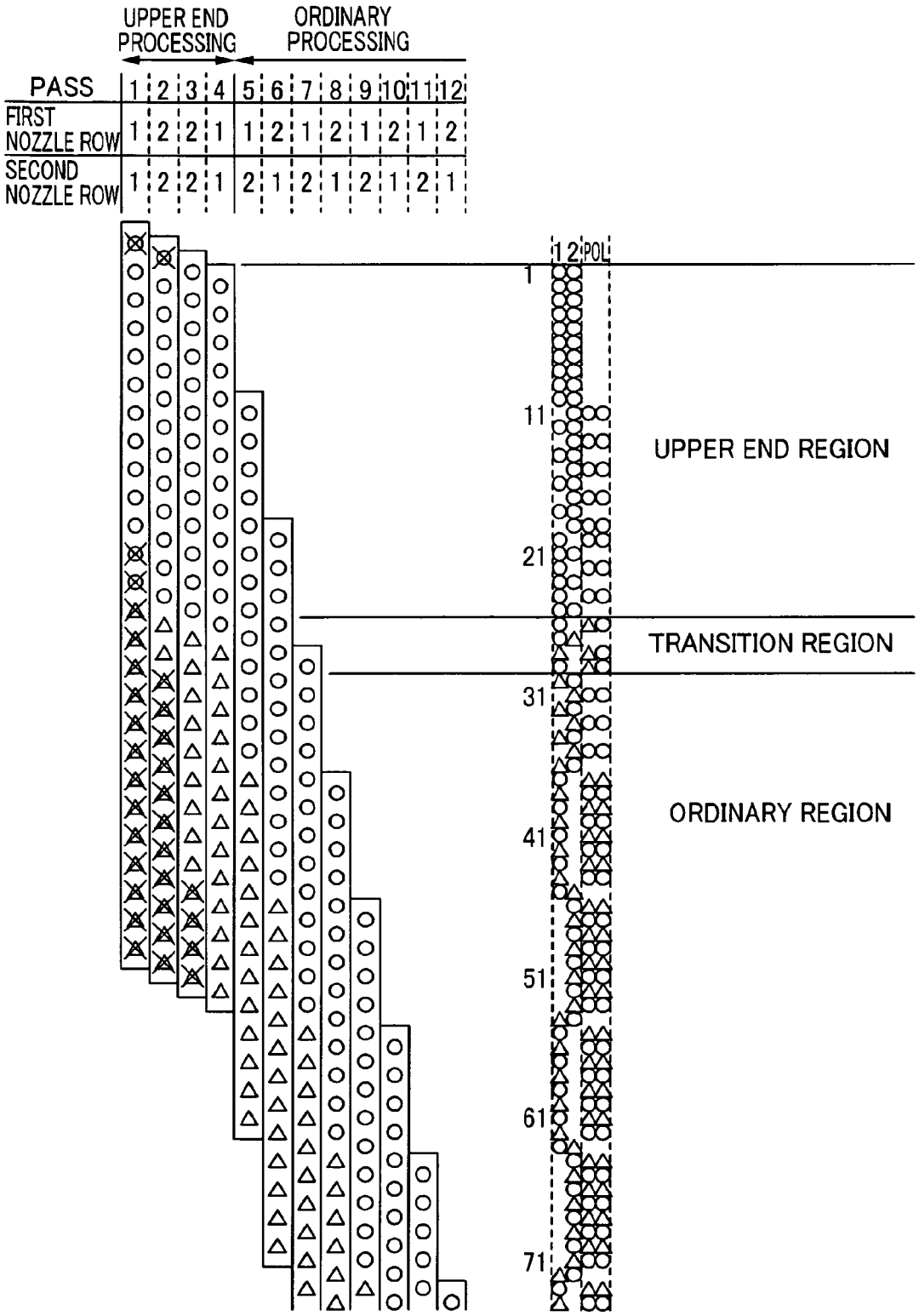
FIG. 7 is an explanatory diagram of a first dot forming method.

FIG. 7 is an explanatory diagram of a first dot forming method. In the first dot forming method, upper end processing is carried out in passes 1 to 4 and ordinary processing is carried out from pass 5 onward. In the transport operation carried out between each pass in upper end processing, the paper is transported by a transport amount D of a one dot portion (a shorter transport amount than the transport amount in ordinary processing).

In upper end processing, each nozzles are positioned at odd number raster lines in odd number passes. After an odd number pass, the paper is transported by a transport amount of one dot portion, and therefore in an even number pass, each nozzles are positioned at even number raster lines. In this way, in upper end processing also, the position of the nozzles alternates in each pass to positions of odd number or even number raster lines.

Incidentally, in the above-described ordinary processing, in order to form dots in zigzag lattice shapes by each nozzle row respectively, in a certain pass the dot forming position of the first nozzle row 42A and the dot forming position of the second nozzle row 42B were caused to be different. For example, when the first nozzle row 42A formed dots at odd number pixels, the second nozzle row 42B formed dots at even number pixels.

In contrast to this, in upper end processing, the dot forming position of the first nozzle row 42A and the dot forming position of the second nozzle row 42B are the same in a certain pass. For example, in pass 1, the first nozzle row 42A and the second nozzle row 42B both form dots at odd number pixels.

Suppose that in upper end processing the dot forming position of the first nozzle row 42A and the dot forming position of the second nozzle row 42B were caused to be different in a certain pass, in the same manner as in ordinary processing, then there would be a risk that dots could not be formed in either the odd number pixels or the even number pixels. This is because the dot forming positions of a plurality of nozzles belonging to the same nozzle row are all the same, and the dot forming positions of the plurality of nozzles belonging to the same nozzle row cannot be varied. As a result, for example, the nozzle #3B in pass 3 and the nozzle #9A in pass 5 that form the 27th raster line would both undesirably form dots at odd number pixels and there would be no nozzle capable of forming dots at even number pixels in the 27th raster line.

Furthermore, in the above-described ordinary processing, in order to form dots in zigzag lattice shapes by each nozzle row respectively, the dot forming positions of each nozzle row in a certain pass and a next pass were caused to be different. For example, in the case where the first nozzle row 42A formed dots at odd number pixels and the second nozzle row 42B formed dots at even number pixels in a certain pass, in the next pass the first nozzle row 42A formed dots at even number pixels and the second nozzle row 42B formed dots at odd number pixels.

In contrast to this, in upper end processing, the dot forming position of each nozzle row is changed in order of odd number pixels (pass 1)→even number pixels (pass 2)→even number pixels (pass 3)→odd number pixels (pass 4). That is, in upper end processing, the dot forming position of each nozzle row is not necessarily different between a certain pass and a next pass. For example, in pass 2 and pass 3, the dot forming positions are the same at even number pixels.

Suppose that, in upper end processing, if the dot forming position of each nozzle row was changed alternately in order of odd number pixels (pass 1)→even number pixels (pass 2)→odd number pixels (pass 3)→even number pixels (pass 4) in the same manner as in ordinary processing, then there would be a risk that dots could not be formed in either the odd number pixels or the even number pixels. For example, the nozzle #2A in pass 1 and the nozzle #1A in pass 3 that form the first raster line would both undesirably form dots at odd number pixels and there would be no nozzle capable of forming dots at even number pixels in the first raster line.

A reason for the above-mentioned difference between ordinary processing and upper end processing is that in contrast to ordinary processing, in which dots are formed in zigzag lattice shapes by each nozzle row respectively, in upper end processing dots are formed in zigzag lattice shapes in the first two of four passes, then, in order to fill spaces between dots formed in those zigzag lattice shapes, dots are formed in zigzag lattice shapes in the second two of four passes.

It should be noted that in upper end processing, the second nozzle row 42B is hardly used in the first two passes. The two nozzles of the second nozzle row 42B used in pass 2 are both used only in a transition region (described later). And in pass 3 onward in upper end processing, the dot forming positions of the second nozzle row 42B commence being changed alternately for each pass in the same manner as in ordinary processing. (The dot forming positions of the second nozzle row 42B from pass 3 onward change in order from even number pixels→odd number pixels→even number pixels→odd number pixels→ . . . ). For this reason, from pass 3 onward (from before ordinary processing), the second nozzle row 42B commences to form dots in a zigzag lattice shape.

In this way, from pass 3 onward the dot forming positions of the second nozzle row 42B are in the same order as ordinary processing. On the other hand, in upper end processing, the paper is transported by only a transport amount that is shorter than the transport amount in ordinary processing. As a result, suppose that ink was undesirably ejected from all the nozzles of the second nozzle row 42B in pass 3, then dots would be formed undesirably in overlapping positions.

Accordingly, at pass 3, it is set so that ink is not ejected from the four nozzles on the transport direction upstream side (nozzle #12B to nozzle #15B). In this way, from pass 3 onward, the transport direction positions of the nozzles on the most transport direction upstream side of the nozzles that eject ink change in each pass by nine dot portions (corresponding to the transport amount in ordinary processing). As a result, from pass 3 onward, the second nozzle row 42B can commence to form dots in a zigzag lattice shape in the same manner as in ordinary processing.

With the above-described dot forming method, the first to 25th raster lines (the raster lines on the upper end side of the paper) are formed by only the first nozzle row 42A. In other words, the usage rate of the nozzle row when forming the first to 25th raster lines is 100% for the first nozzle row 42A and 0% for the second nozzle row 42B. In the following description, a region of the first to 25th raster lines is referred to as an "upper end region".

The usage rate of each nozzle row when forming raster lines on the transport direction upstream side from the 30th raster line is 50% for the first nozzle row 42A and 50% also for the second nozzle row 42B. In the following description, a region of the transport direction upstream side from the 30th raster line is referred to as an "ordinary region".

The transition region is present between the upper end region and the ordinary region. In the transition region, raster lines are present that have an intermediate character of the upper end region and the ordinary region such that the usage rate of the first nozzle row 42A is 75% and the usage rate of the second nozzle row 42B is 25% as in the 26th raster line for example. In the first dot forming method, the transition region is constituted by four raster lines (the 26th to 29th raster lines)

Second Dot Forming Method

Next, description is given regarding a second dot forming method. Compared to the above-described first dot forming method, a manner of using overlapping nozzles in upper end processing (the nozzles #12A to #15A and the nozzles #1B to #4B) is different in the second dot forming method.

Figure 8:
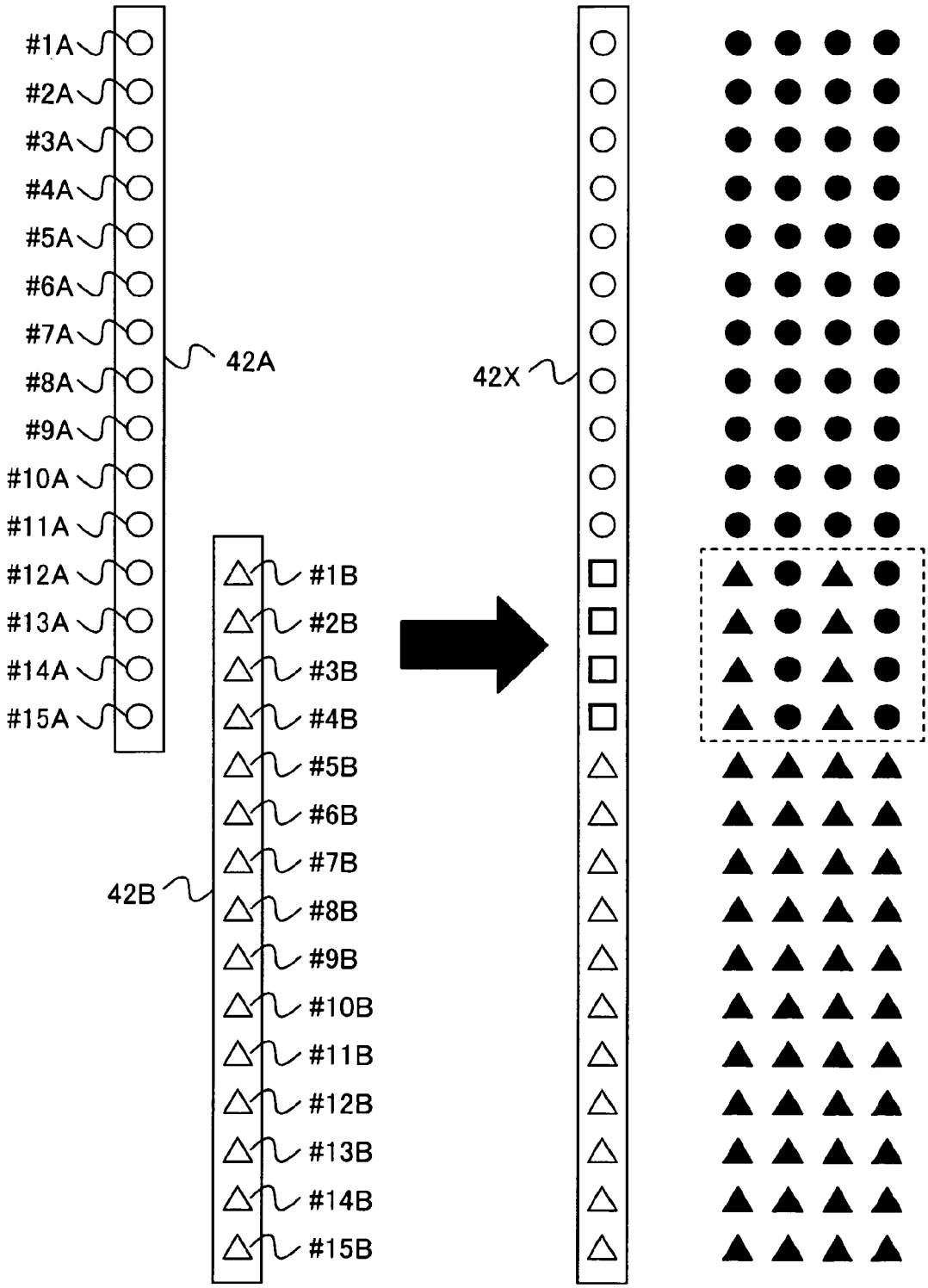
FIG. 8 is an explanatory diagram of a virtual nozzle row used in describing a second dot forming method.

FIG. 8 is an explanatory diagram of a virtual nozzle row used in describing the second dot forming method. Here, two nozzles whose transport direction positions overlap (for example, the nozzle #12A and nozzle #1B) are shown as one nozzle having a square mark. Description is given of the two nozzle rows using this single virtual nozzle row.

It should be noted that when square mark nozzles form dots, the nozzles of the first nozzle row 42A are used at a half ratio and the nozzles of the second nozzle row 42B are used at a remaining half ratio. For example, as shown on the right side in FIG. 8, when a square mark nozzle forms four dots, two dots are formed by nozzles of the first nozzle row 42A and the remaining two dots are formed by nozzles of the second nozzle row 42B.

Figure 9:
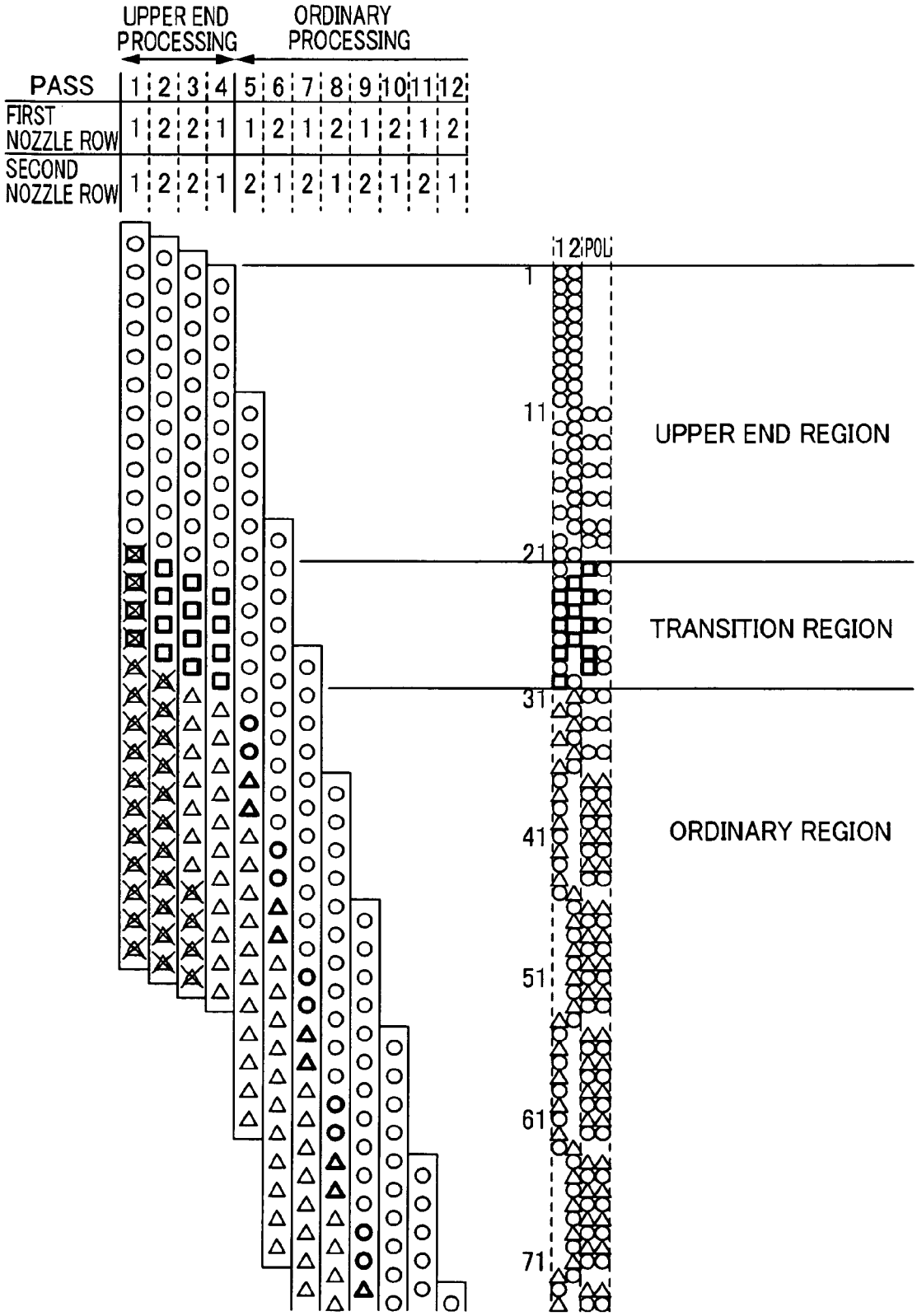
FIG. 9 is an explanatory diagram of the second dot forming method.

FIG. 9 is an explanatory diagram of the second dot forming method. The overlapping nozzles of the virtual nozzle row are shown by bold lines. In the same manner as the first dot forming method, upper end processing is carried out in passes 1 to 4 and ordinary processing is carried out from pass 5 onward also in the second dot forming method.

The ordinary processing is the same as in the above-described first dot forming method. As already described, in the case of ordinary processing, only one of the two nozzles whose transport direction positions overlap (a nozzle of the first nozzle row 42A and a nozzle of the second nozzle row 42B) is used and the other is not used. For example, of the nozzle #12A and nozzle #1B, only the nozzle #12A is used and the nozzle #1B is not used (see FIG. 4).

On the other hand, compared to the above-described first dot forming method, the manner of using overlapping nozzles is different in upper end processing. Overlapping nozzles in the virtual nozzle row for passes 1 to 4 in FIG. 9 are shown by square marks, and when dots are formed at pixels associated with square mark overlapping nozzles, the nozzles of the first nozzle row 42A are used at a half ratio and the nozzles of the second nozzle row 42B are used at a remaining half ratio.

For example, the square mark nozzles (pass 3) are associated with even number pixels in the 23rd raster line. For this reason, the nozzle #12A of the first nozzle row 42A forms dots for half the pixels of even number pixels, and the nozzle #1B of the second nozzle row 42B forms dots for the remaining half of the pixels of even number pixels. As a result, in the 23rd raster line, nozzles of the first nozzle row 42A form dots every three in four pixels and the nozzles of the second nozzle row 42B form dots every one in four pixels. That is, the nozzle usage rate of the first nozzle row 42A is 75% and the nozzle usage rate of the second nozzle row 42B is 25%.

Furthermore, for example, the square mark nozzles (pass 2) and the circle mark nozzles (pass 6) are associated as POL nozzles with even number pixels in the 22nd raster line. For this reason, square mark nozzles are associated with half of the pixels of even number pixels. That is, square mark nozzles are associated with every one in four pixels. As a result, in the 22nd raster line, nozzles of the first nozzle row 42A form dots every seven in eight pixels and the nozzles of the second nozzle row 42B form dots every one in eight pixels. That is, the nozzle usage rate of the first nozzle row 42A is 87.5% and the nozzle usage rate of the second nozzle row 42B is 12.5%.

By causing the manner of using overlapping nozzles in upper end processing to be different from the manner of using overlapping nozzles in ordinary processing, the transition region in the second dot forming method has an increased number of raster lines compared to the transition region in the first dot forming method. In the second dot forming method, the transition region is constituted by nine raster lines (the 22nd to 30th raster lines).

Third Dot Forming Method

Next, description is given regarding a third dot forming method. The third dot forming method is different from the above-described first dot forming method (and different from the second dot forming method) in that there is transition processing between the upper end processing and ordinary processing. However, the manner of using overlapping nozzles in the third dot forming method is equivalent to the above-described first dot forming method.

Figure 10:
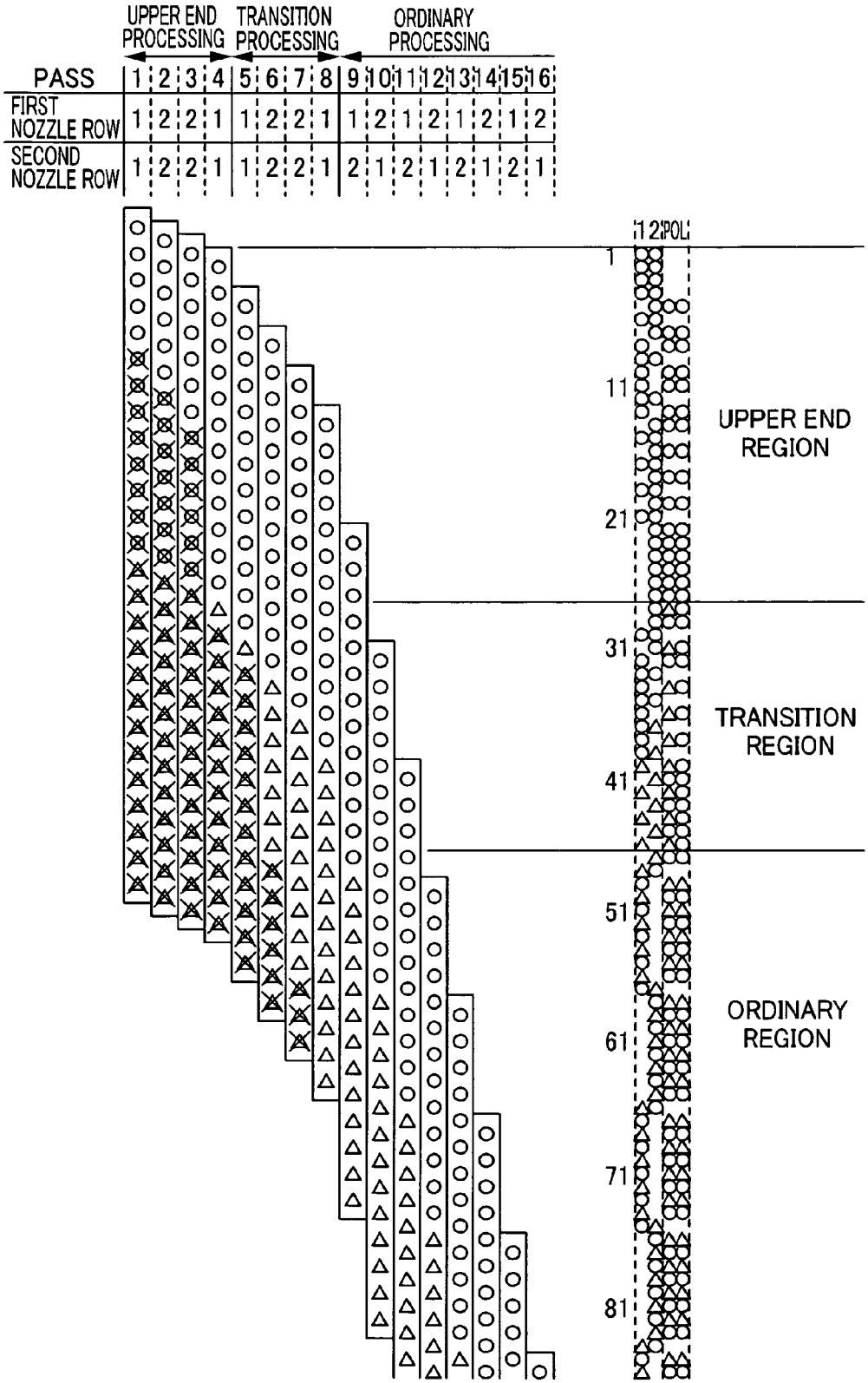
FIG. 10 is an explanatory diagram of a third dot forming method.

FIG. 10 is an explanatory diagram of the third dot forming method. In the third dot forming method, upper end processing is carried out in passes 1 to 4, transition processing is carried out in passes 5 to 8, and ordinary processing is carried out in pass 9 onward. Although some of the nozzles that do not eject ink are different, the upper end processing and ordinary processing of the third dot forming method are equivalent to the above-described first dot forming method.

In the transport operation in transition processing, the paper is transported by a transport amount 3D of three dot portions. The transport amount 3D is longer than the transport amount D of upper end processing and shorter than the transport amount 9D of ordinary processing. That is, in the third dot forming method, the transport amount is gradually increased in a period from the end of upper end processing until the start of ordinary processing.

In the same manner as upper end processing, in transition processing, the dot forming position of the first nozzle row 42A in a certain pass and the dot forming position of the second nozzle row 42B are the same. For example, in pass 5, the first nozzle row 42A and the second nozzle row 42B both form dots at odd number pixels.

Furthermore, in the same manner as upper end processing, in transition processing, the dot forming position of each nozzle row is changed in order of odd number pixels (pass 5)→even number pixels (pass 6)→even number pixels (pass 7)→odd number pixels (pass 8). That is, in transition processing, the dot forming position of each nozzle row is not necessarily different between a certain pass and a next pass. For example, in pass 6 and pass 7, the dot forming positions are the same at even number pixels. Further still, the dot forming position of a final pass in upper end processing and the dot forming position of a first pass in transition processing are the same at odd number pixels.

Furthermore, in pass 7 onward in transition processing, the dot forming positions of the second nozzle row 42B commence being changed alternately for each pass in the same manner as in ordinary processing (the dot forming positions of the second nozzle row 42B from pass 7 onward change in order from even number pixels→odd number pixels→even number pixels→odd number pixels→ . . . ). For this reason, from pass 7 onward (from before ordinary processing), the second nozzle row 42B commences to form dots in a zigzag lattice shape.

In this way, from pass 7 onward the dot forming positions of the second nozzle row 42B are in the same order as ordinary processing. On the other hand, in transition processing, the paper is transported by only a transport amount that is shorter than the transport amount in ordinary processing. As a result, suppose that ink was undesirably ejected from all the nozzles of the second nozzle row 42B in pass 7, then dots would be formed undesirably in overlapping positions.

Accordingly, at pass 7, it is set so that ink is not ejected from the four nozzles on the transport direction upstream side (nozzle #12B to nozzle #15B). In this way, from pass 7 onward, the transport direction positions of the nozzles on the most transport direction upstream side of the nozzles that eject ink change in each pass by nine dot portions (corresponding to the transport amount in ordinary processing). As a result, from pass 3 onward, the second nozzle row 42B can commence to form dots in a zigzag lattice shape in the same manner as in ordinary processing.

By carrying out the above-described transition processing, the transition region in the third dot forming method has an increased number of raster lines compared to the transition region in the first dot forming method. In the third dot forming method, the transition region is constituted by 19 raster lines (the 28th to 46th raster lines).

Fourth Dot Forming Method

Next, description is given regarding a fourth dot forming method. In the fourth dot forming method, transition processing is carried out in the same manner as the above-described third dot forming method. However, compared the above-described third dot forming method, a manner of using overlapping nozzles in upper end processing and transition processing (the nozzles #12A to #15A and the nozzles #1B to #4B) is different in the fourth dot forming method. It should be noted that the manner of using overlapping nozzles in the fourth dot forming method is common with to the above-described second dot forming method.

Figure 11:
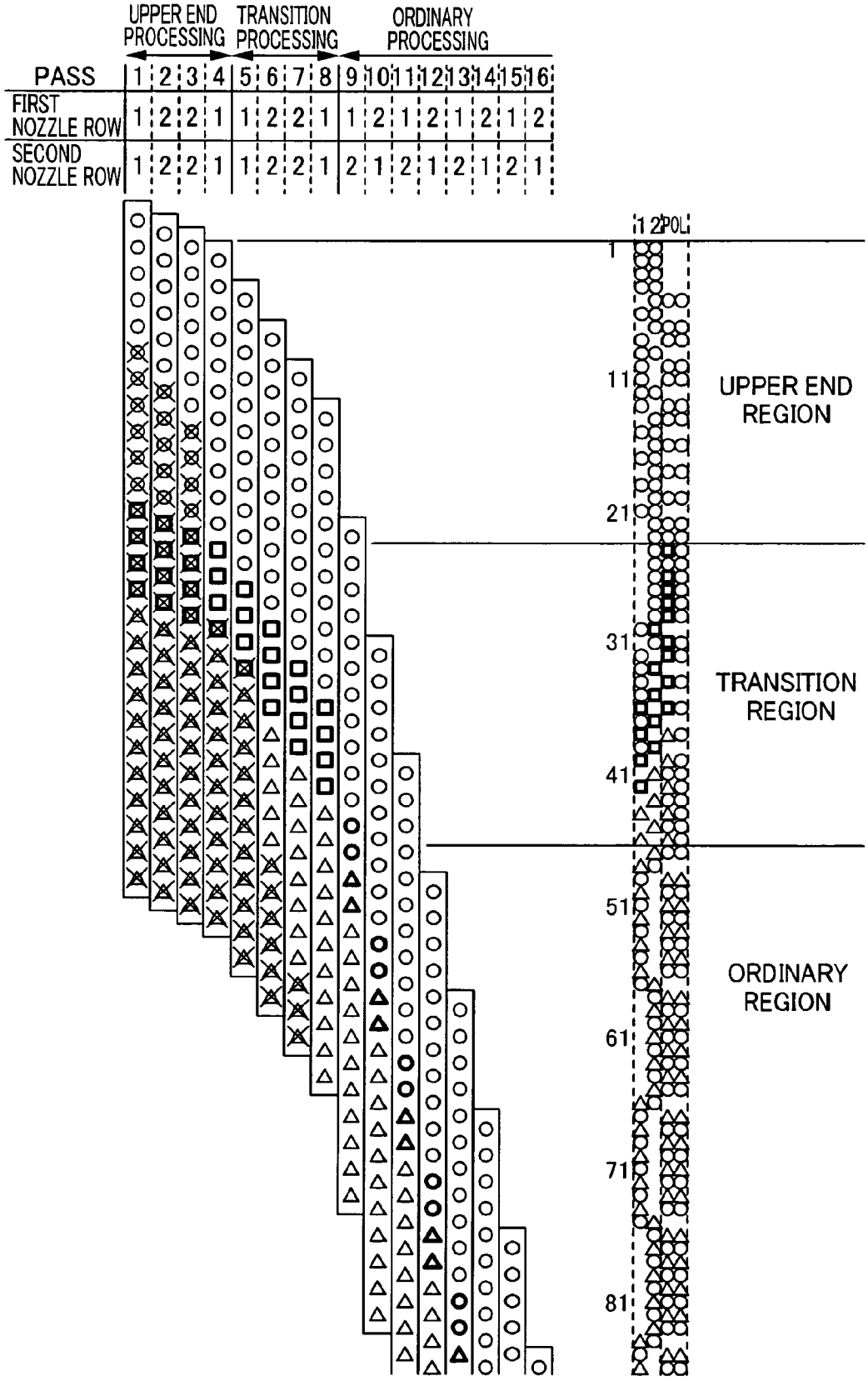
FIG. 11 is an explanatory diagram of a fourth dot forming method.

FIG. 11 is an explanatory diagram of the fourth dot forming method. The overlapping nozzles of the virtual nozzle row are shown by bold lines.

Compared to the above-described third dot forming method, the manner of using overlapping nozzles is different in upper end processing. overlapping nozzles in the virtual nozzle row for passes 1 to 4 in FIG. 11 are shown by square marks, and when dots are formed at pixels associated with square mark nozzles, the nozzles of the first nozzle row 42A are used at a half ratio and the nozzles of the second nozzle row 42B are used at a remaining half ratio.

For example, the square mark nozzles (pass 6) are associated with even number pixels in the 30th raster line. For this reason, the nozzle #12A of the first nozzle row 42A forms dots for half the pixels of even number pixels, and the nozzle #1B of the second nozzle row 42B forms dots for the remaining half of the pixels of even number pixels. As a result, in the 30th raster line, nozzles of the first nozzle row 42A form dots every three in four pixels and the nozzles of the second nozzle row 42B form dots every one in four pixels. That is, the nozzle usage rate of the first nozzle row 42A is 75% and the nozzle usage rate of the second nozzle row 42B is 25%.

Furthermore, for example, the square mark nozzles (pass 4) and the circle mark nozzles (pass 8) are associated as POL nozzles with odd number pixels in the 24th raster line. For this reason, square mark nozzles are associated with half of the pixels of odd number pixels. That is, square mark nozzles are associated with every one in four pixels. As a result, in the 24th raster line, nozzles of the first nozzle row 42A form dots every seven in eight pixels and the nozzles of the second nozzle row 42B form dots every one in eight pixels. That is, the nozzle usage rate of the first nozzle row 42A is 87.5% and the nozzle usage rate of the second nozzle row 42B is 12.5%.

By causing the manner of using overlapping nozzles in upper end processing and transition processing to be different from the manner of using overlapping nozzles in ordinary processing, the transition region in the fourth dot forming method has an increased number of raster lines compared to the transition region in the third dot forming method. In the fourth dot forming method, the transition region is constituted by 23 raster lines (the 24th to 46th raster lines).

Comparison (1)

First, a comparison is made of numbers of raster lines in the transition regions.

Figure 12A:
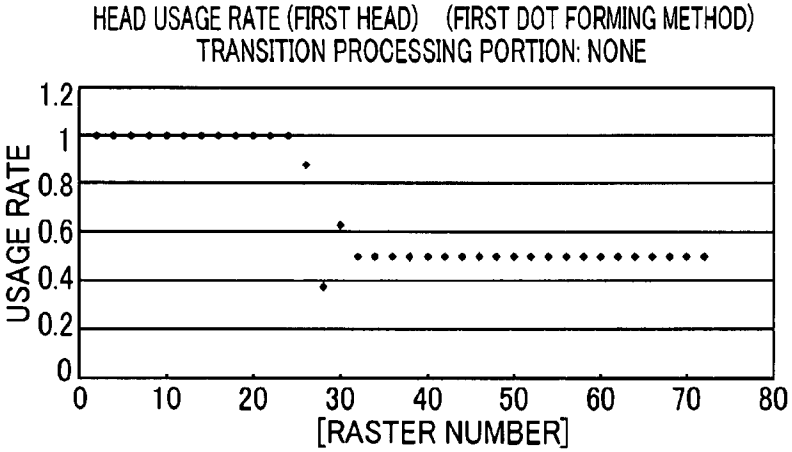
FIGS. 12A to 12D are graphs of nozzle usage rates.
Figure 12B:
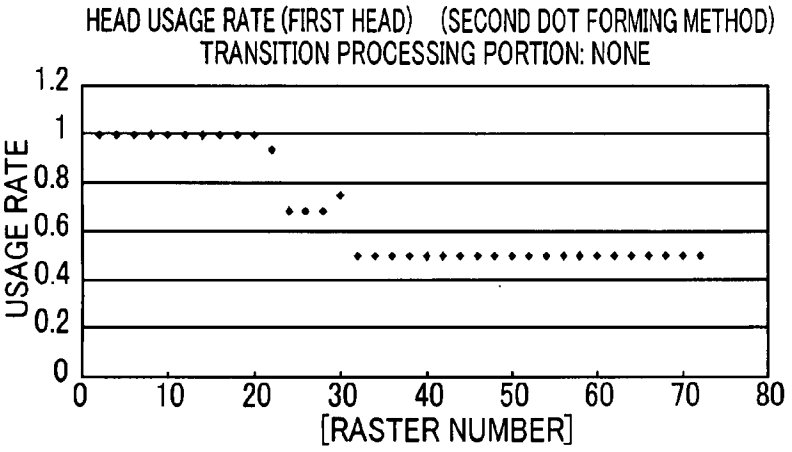
Figure 12C:
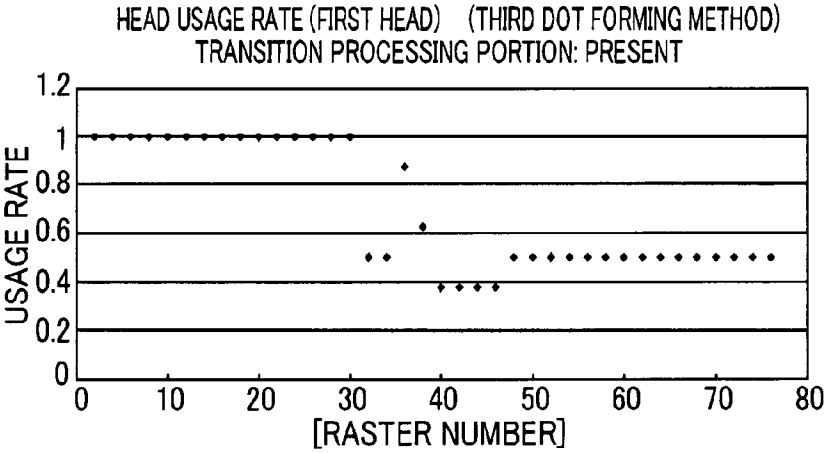
Figure 12D:
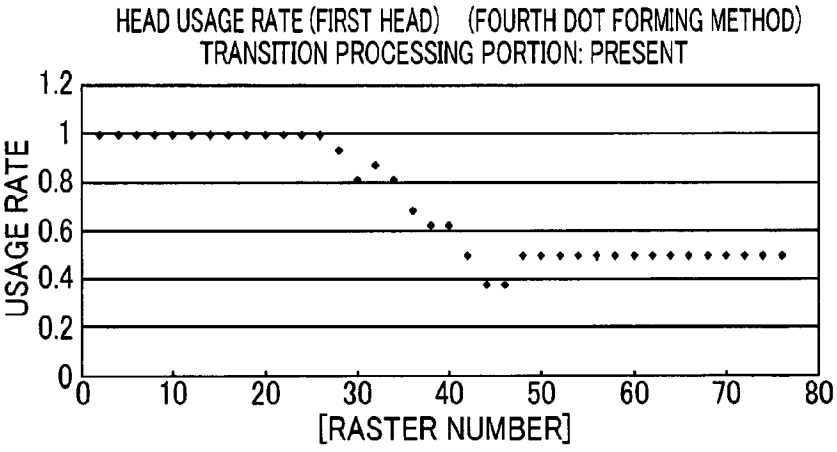

FIGS. 12A to 12D are graphs of nozzle usage rates. FIG. 12A (upper left) is a graph of nozzle usage rates in the first dot forming method. FIG. 12B (lower left) is a graph of nozzle usage rates in the second dot forming method. FIG. 12C (upper right) is a graph of nozzle usage rates in the third dot forming method. FIG. 12D (lower right) is a graph of nozzle usage rates in the fourth dot forming method.

The horizontal axes of the graphs indicate the raster line number. The vertical axes of the graphs indicate the usage rates of the first nozzle row 42A. In each of the dot forming methods, the usage rate of the first nozzle row 42A in the upper end region is 100% and the usage rate of the first nozzle row 42A in the ordinary region is 50%. It should be noted that the points in the graph indicate mean values of the usage rates for two raster lines.

In comparing the first dot forming method (FIG. 12A) and the second dot forming method (FIG. 12B), the number of raster lines in the transition region is greater in the second dot forming method. Also, in comparing the third dot forming method (FIG. 12C) and the fourth dot forming method (FIG. 12D), the number of raster lines in the transition region is greater in the fourth dot forming method. By causing the manner of using overlapping nozzles in upper end processing and transition processing to be different from the manner of using overlapping nozzles in ordinary processing in this manner, the number of raster lines in the transition region can be increased. In other words, by using nozzles not used in ordinary processing (nozzle #14A, nozzle #15A, nozzle #1B, and nozzle #2B) when performing upper end processing and transition processing, the number of raster lines in the transition region can be increased.

In comparing the first dot forming method (FIG. 12A) and the third dot forming method (FIG. 12C), the number of raster lines in the transition region is greater in the third dot forming method. Also, in comparing the second dot forming method (FIG. 12B) and the fourth dot forming method (FIG. 12D), the number of raster lines in the transition region is greater in the fourth dot forming method. By carrying out transition processing between upper end processing and ordinary processing in this manner, the number of raster lines in the transition region can be increased.

It is considered that picture quality is improved when the number of raster lines in the transition region is increased. A reason for this is described below.

In the upper end region, raster lines are formed by only the first nozzle row 42A. For this reason, the picture quality in the upper end region strongly reflects characteristics of the first nozzle row 42A. For example, in the case where the ink amount ejected from the first nozzle row 42A is large due to manufacturing error, the upper end region becomes a dark image. On the other hand, the picture quality in the ordinary region reflects characteristics of both the first nozzle row 42A and the second nozzle row 42B. For example, even when the ink amount ejected from the first nozzle row 42A is large due to manufacturing error, if the ink amount ejected from the second nozzle row 42B is small, then the image in the ordinary region will not become darker than the image in the upper end region. In this manner, the picture quality of the upper end region and the picture quality of the ordinary region will be different.

When the number of raster lines in the transition region is small, the difference between the picture quality of the upper end region and the picture quality of the ordinary region tends to become conspicuous since the two regions are close to each other. On the other hand, since raster lines having an intermediate character of the upper end region and the ordinary region are present in the transition region (for example, a raster line in which the usage rate of the first nozzle row 42A is 75%), when the number of raster lines in the transition region is large, the difference between the picture quality of the upper end region and the picture quality of the ordinary region does not tend to become conspicuous.

As described above, it is considered that picture quality is improved when the number of raster lines in the transition region is increased. For this reason, the second dot forming method has better picture quality than the first dot forming method. Furthermore, the fourth dot forming method has better picture quality than the third dot forming method. Furthermore, the third dot forming method has better picture quality than the first dot forming method. Furthermore, the fourth dot forming method has better picture quality than the second dot forming method.

Comparison (2)

Next, a comparison is made of states of usage rates in the transition region.

In comparing change in usage rates in the transition regions in the third dot forming method (FIG. 12C) and the fourth dot forming method (FIG. 12D), the change is more gradual in the fourth dot forming method. In other words, in the fourth dot forming method, for the raster lines in the transition region, the usage rates of the first nozzle row 42A in raster lines closer to the upper end region are values closer to 100%, and the usage rates of the first nozzle row 42A in raster lines closer to the ordinary region are values closer to 50%. In contrast to this, in the third dot forming method, this tendency is almost not present at all. Although it may be difficult to grasp since the transition regions are narrow, it should be noted that in comparing change in usage rates in the transition regions in the first dot forming method (FIG. 12A) and the second dot forming method (FIG. 12B), the change is more gradual in the second dot forming method. By causing the manner of using overlapping nozzles in upper end processing and transition processing to be different from the manner of using overlapping nozzles in ordinary processing in this manner, the usage rates in the transition region can be caused to change gradually.

In comparing change in usage rates in the transition regions in the second dot forming method (FIG. 12B) and the fourth dot forming method (FIG. 12D), the change is more gradual in the fourth dot forming method. And although it may be difficult to grasp since the transition regions are narrow, it should be noted that in comparing change in usage rates in the transition regions in the first dot forming method and the third dot forming method, the change is more gradual in the third dot forming method. By carrying out transition processing between upper end processing and ordinary processing in this manner, the usage rates in the transition region can be caused to change gradually.

When the usage rate of the first nozzle row 42A changes gradually in the transition region, the picture quality in the transition region changes gradually from a picture quality close to the upper end region to a picture quality close to the ordinary region. As a result, the difference in the picture quality of the upper end region and the picture quality of the ordinary region does not tend to become conspicuous and the overall picture quality of the printed image is improved. For this reason, the fourth dot forming method has better picture quality than the third dot forming method. Furthermore, the second dot forming method has better picture quality than the first dot forming method. Furthermore, the fourth dot forming method has better picture quality than the second dot forming method. And the third dot forming method has better picture quality than the first dot forming method.

Actual Usage Rates

The above-described FIGS. 12A to 12D were graphs of usage rates for a case where there are 15 nozzles in each nozzle row, but the actual number of nozzles in the nozzle rows is 180 nozzles.

Figure 13:
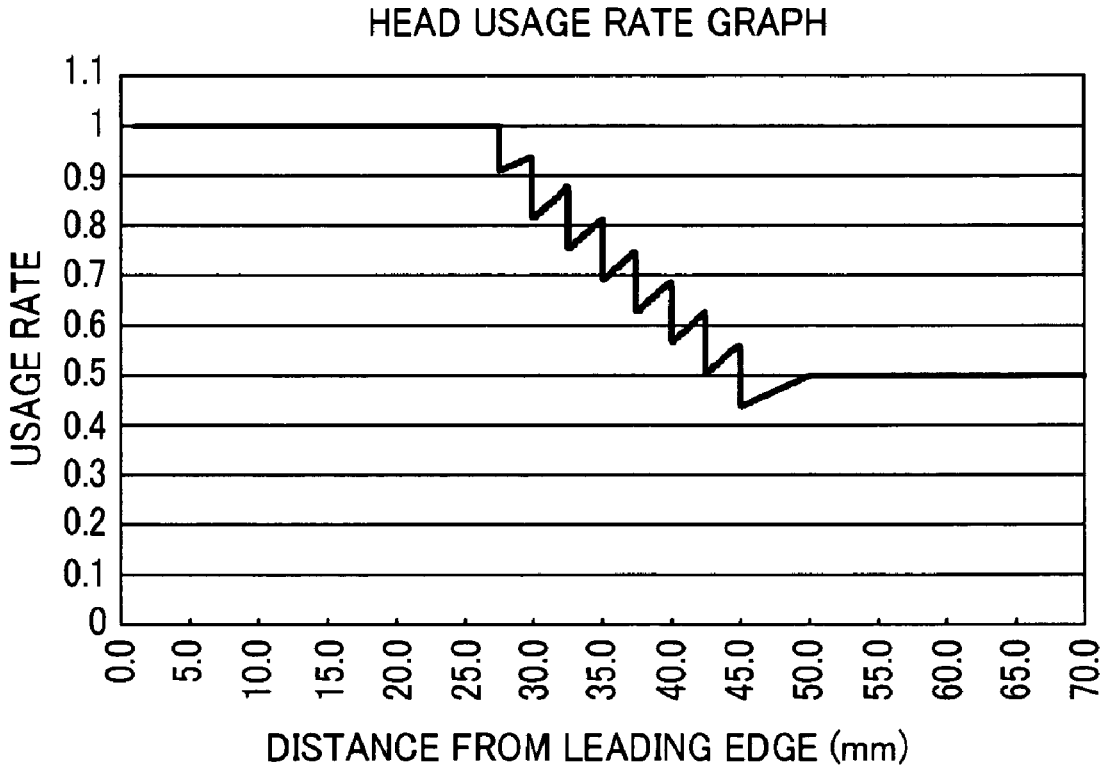
FIG. 13 is a graph of usage rates of the first nozzle row when the fourth dot forming method is carried out using a nozzle row having 180 nozzles.

FIG. 13 is a graph of usage rates of the first nozzle row 42A when the fourth dot forming method is carried out using a nozzle row having 180 nozzles. By increasing the number of nozzles in this manner, it becomes clearer how the usage rates gradually change in the transition region.

It should be noted that usage rate data shown in the diagrams is provided in advance in the printer driver as a usage rate table. Furthermore, the usage rate varies in different dot forming methods even if the raster number is the same, and therefore the printer driver is provided with a usage rate table for each dot forming method respectively.

The usage rate tables maybe used in color irregularity corrections.

Color Irregularity Corrections of First Embodiment

Due to the influence of such factors as manufacturing error in the nozzle rows, the amount of ink ejected from each nozzle row is not uniform. For this reason, a nozzle row that ejects a larger amount of ink than a standard amount will print undesirably dark, and a nozzle row that ejects a smaller amount of ink than the standard amount will print undesirably light, such that there is a risk of color irregularities being produced in the printed image.

Accordingly, color irregularities are suppressed in images to be printed by increasing/decreasing the dots that constitute each raster line by performing the following color irregularity correction. Next, description is given of a procedure in color irregularity correction processing.

Process of Obtaining Color Irregularity Correction Values

Figure 14:
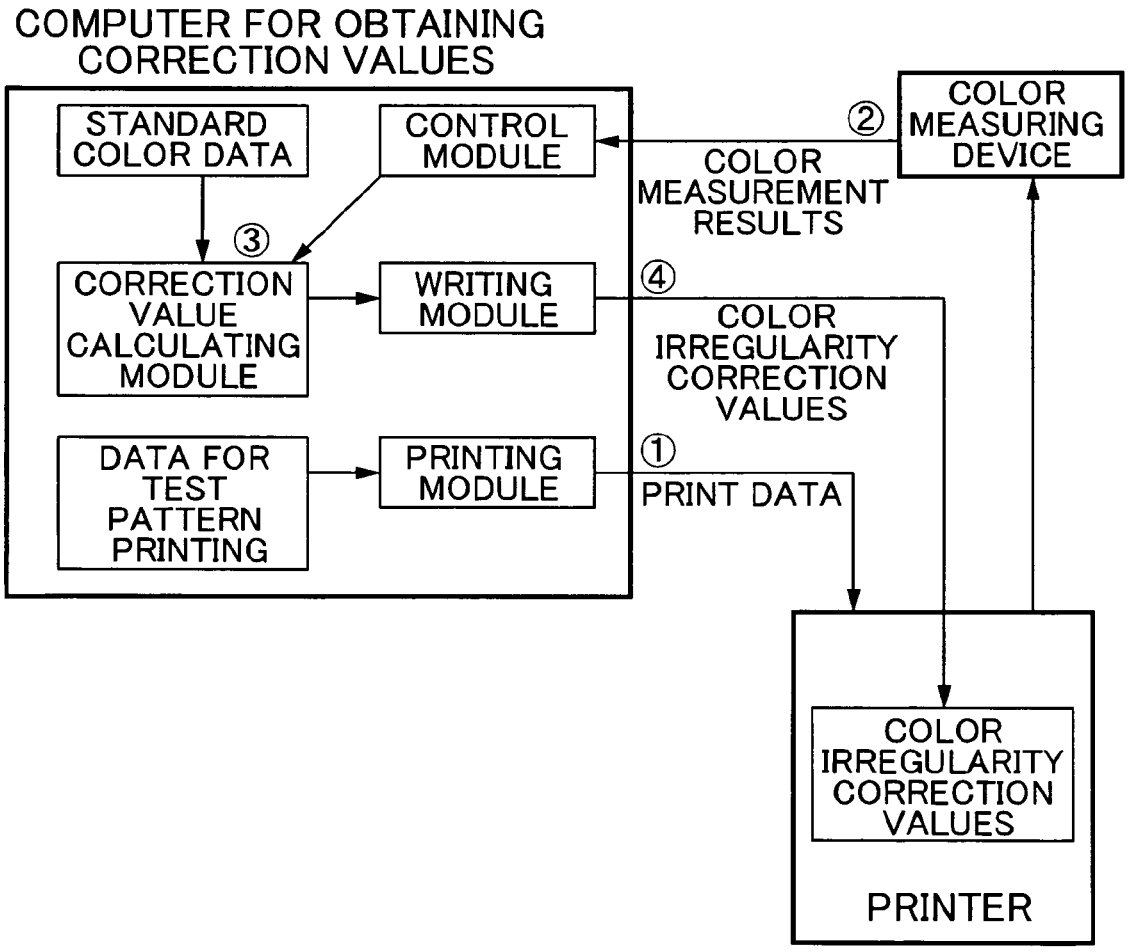
FIG. 14 is an explanatory diagram of a process of obtaining color irregularity correction values.

FIG. 14 is an explanatory diagram of a process of obtaining color irregularity correction values carried out in a printer manufacturing plant. A computer for obtaining correction values and a color measuring device are prepared at the printer manufacturing plant. The color measuring device is connected in advance to the computer. When a printer is manufactured at the plant, that printer is to be connected to the computer for obtaining correction values. Each of the modules drawn inside the computer in FIG. 14 is achieved by software and hardware.

First, a printing module of the computer generates print data based on data for test pattern printing and sends this to the printer. The printing module is equivalent to a so-called printer driver. The data for test pattern printing is stored in advance in a memory of the computer.

Next, upon receiving the print data, the printer prints the test pattern and a measurement operator performs color measuring on the printed test pattern using the color measuring device. A multitude of patch patterns are formed in the test pattern and a control module obtains color measurement results of each patch pattern from the color measuring device.

Next, a correction value calculating module compares the color measurement results and standard color data that has been stored in advance, and calculates color irregularity correction values.

Finally, a writing module writes the color irregularity correction values into a memory of the printer. The printer is shipped from the plant with the color irregularity correction values stored in its memory.

FIG. 15 is an explanatory diagram of color irregularity correction values. Color irregularity correction values are prepared for a first nozzle row group and a second nozzle row group respectively. Furthermore, three types of color irregularity correction values (for small dots, medium dots, and large dots) are prepared for each nozzle row of each nozzle row group (for each ink color).

When the correction value is "100", this means that the same ink amount as a standard amount is to be ejected from the nozzle. For example, a cyan nozzle row of the second nozzle row group ejects the same ink amount as the standard amount when it ejects a small dot.

When the correction value is more than 100, this means that an ink amount greater than the standard amount is to be ejected from the nozzle. For example, a cyan nozzle row of the first nozzle row group ejects an ink amount greater than the standard amount when it ejects a small dot. For this reason, when this nozzle row forms dots, a dark image is produced.

When the correction value is less than 100, this means that an ink amount smaller than the standard amount is to be ejected from the nozzle. For example, a cyan nozzle row of the first nozzle row group ejects an ink amount smaller than the standard amount when it ejects a large dot. For this reason, when this nozzle row forms dots, a light image is produced.

It should be noted that in the description above, color irregularity correction values were obtained by performing color measurements on a test pattern, but there is no limitation to this. For example, color irregularity correction values equivalent to those of FIG. 15 may be obtained by directly measuring the ink amount of an ink droplet that has been ejected.

Processing During Printing

Figure 16:
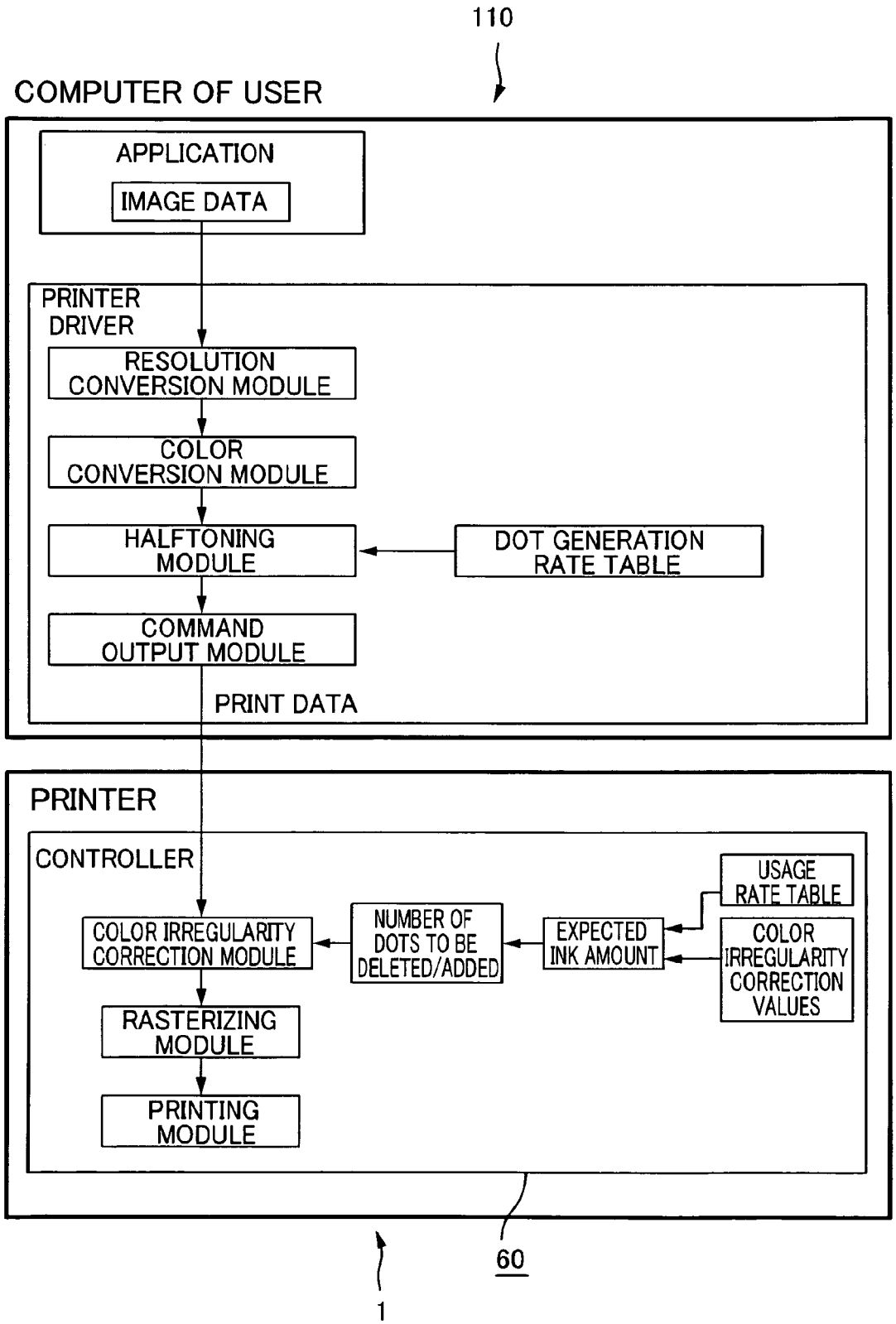
FIG. 16 is a block diagram of processing when a user conducts printing.
Figure 17:
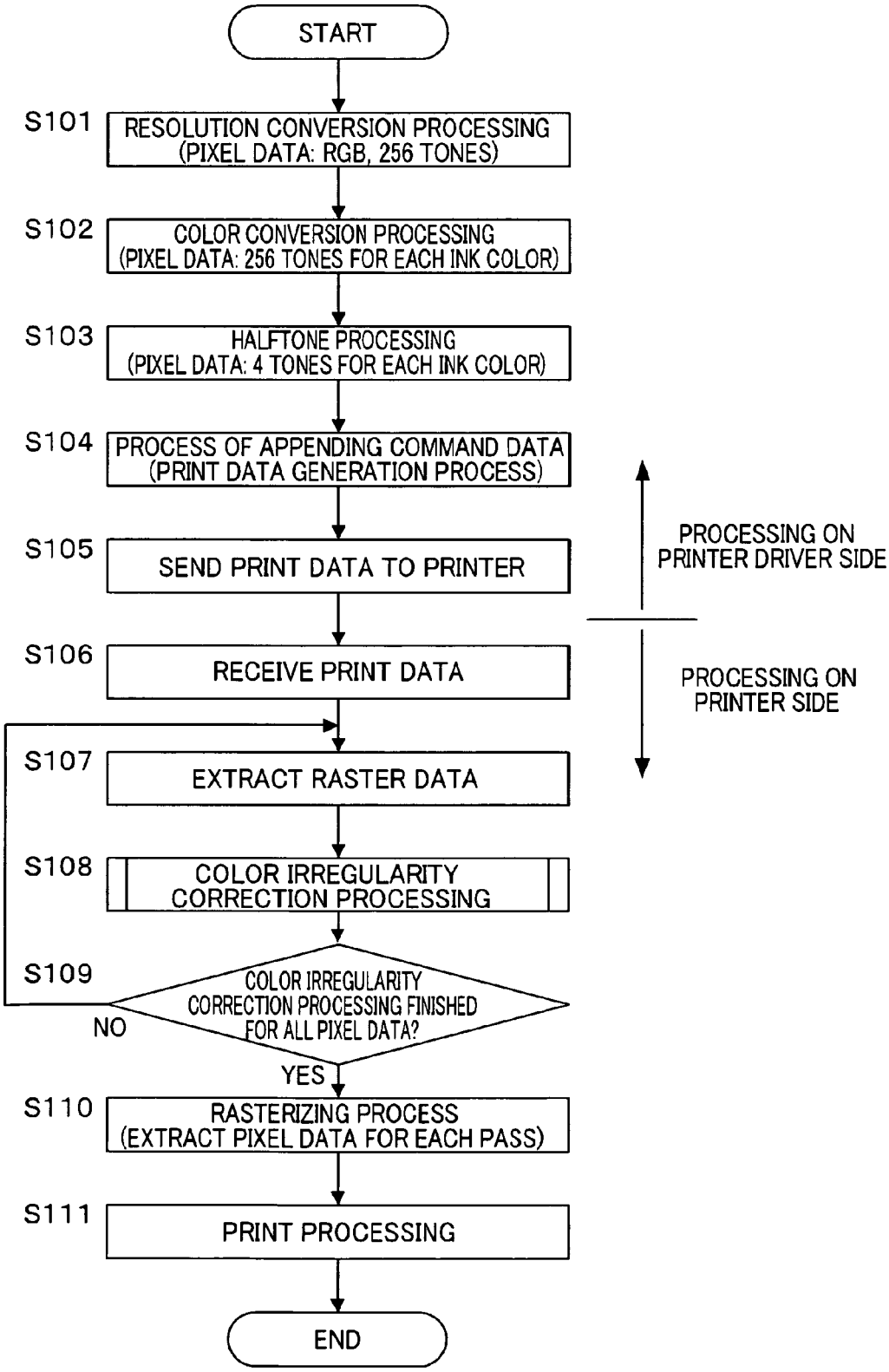
FIG. 17 is a flowchart of processes carried out by the printer driver and a printer-side controller 60.

FIG. 16 is a block diagram of processing when a user conducts printing. FIG. 17 is a flowchart of processes carried out by the printer driver and a printer-side controller 60. The printer driver, which is a program, works together with hardware (a CPU and a memory and the like) of the computer 110 to achieve the various modules of FIG. 16 and the various processes of FIG. 17. Furthermore, the printer-side controller 60 works together with programs stored in the memory 63 to achieve the various modules of FIG. 16 and the various processes of FIG. 17.

First, the printer driver performs a resolution conversion process (S101). The resolution conversion process is a process in which image data (such as text data and image data) outputted from an application is converted into image data having a resolution (print resolution) for printing on paper. For example, in the case where the print resolution has been specified as 1,440×720 dpi, then vector image data received from the application is converted to image data having a resolution of 1,440×720 dpi. Data of each pixel of the image data after the resolution conversion process is data indicating a tone value of 256 tones in an RGB color space.

It should be noted that an image expressed by image data after the resolution conversion process is constituted by pixels arranged in a matrix form. Each pixel has a tone value of 256 tones in the RGB color space. Pixel data that has undergone resolution conversion indicates tone values of corresponding pixels. Pixel data corresponding to a one row portion of pixels lined up in a horizontal direction among the pixels arranged in the matrix form is referred to as "raster data" in the following description. It should be noted that the direction in which pixels corresponding to raster data line up corresponds to the movement direction of the nozzle rows when printing an image.

Next, the printer driver performs a color conversion process (S102). The color conversion process is a process in which data of the RGB color space is converted to data of a color space corresponding to the colors of the inks of the printer. The pixel data after color conversion processing is data indicating tone values of 256 tones expressed using an eight-dimensional color space of C, M, Y, K, LC, LM, LK, and LLK.

Next, the printer driver performs a halftone process (S103). The halftone process is a process in which the pixel data having 256 tones is converted to pixel data of four tones, which is the number of tones that the printer can form. The four-tone pixel data after halftone processing is data indicating a size of the dot to be formed in the corresponding pixel. Specifically, it is data indicating one of large dot, medium dot, small dot, or no dot. For this reason, the image data after halftone processing expresses print image constituted by dots.

It should be noted that the printer driver uses a dot generation rate table in the halftone processing. The dot generation rate table is a data table indicating a probability (dot generation rate) of a dot to be generated with respect to the tone values of the 256 tones. For example, in the dot generation rate table, when a small dot generation rate of 40% and a medium dot and large dot generation rate of 0% is associated with a tone value of 20, if the tone value of certain pixel data of 256 tones is 20, then, as a result of halftone processing, that pixel data is converted to pixel data (four tones) indicating a 40% probability of a small dot and converted to pixel data (four tones) indicating a 60% probability of no dot.

Next, the printer driver appends command data to the pixel data that has undergone halftone processing and generates print data (S104), and sends the print data to the printer (S105).

Next, the printer-side controller 60 receives the print data from the printer driver (S106). By carrying out the following processes, the controller 60 controls each unit in accordance with the command data in the print data, and forms dots in pixels on the paper to print an image by ejecting ink from the nozzles in accordance with the pixel data in the print data.

Next, the controller 60 extracts raster data (S107). Specifically, pixel data corresponding to pixels of one row portion lined up in the horizontal direction is extracted from the image data of a certain color (cyan for example). Since halftone processing has already been carried out, the extracted raster data indicates dots that constitute a raster line.

Next, the controller 60 carries out color irregularity correction processing on the extracted raster data (S108). As is described later, the number of pixel data indicating that a dot is to be formed is increased or decreased by the color irregularity correction processing.

Next, the controller 60 judges whether or not color irregularity correction processing is finished for all the raster data (S109). For example, when there is other raster data of cyan, it judges "No", and when there is raster data of a different color, it also judges "NO".

In the present embodiment, the processing of steps S107 to S109 is carried out repetitively on the image data that has already undergone halftone processing (S103). In other words, in the present embodiment, color irregularity correction processing is executed on the image data that has already undergone halftone processing (S103). There are various techniques such as dithering methods and error diffusion methods for halftone processing, but the present embodiment makes it possible to carry out color irregularity correction processing (described later) by focusing simply on only the manner of arranging dots after halftone processing without depending on the technique of halftone processing. It should be noted that since printer driver development and printer development are sometimes carried out separately, there is an advantage for printer driver development if it is possible to carry out color irregularity correction processing without depending on the halftone processing technique.

Next, the controller 60 carries out a rasterizing process (S110). The rasterizing process is a process in which pixel data of pixels to be formed as dots in each pass is extracted from the image data and rearranged into pixel data for each pass. For example, in the case of the fourth dot forming method in FIG. 11, pixel data of odd number pixels of the first, third, fifth, and seventh raster line are extracted as pixel data of pixels in which dots are to be formed in pass 1.

Finally, the controller 60 carries out print processing (S111). More specifically, the controller 60 controls each unit in accordance with the command data in the print data, achieves one of the above-described first to fourth dot forming methods by ejecting ink from the nozzles in accordance with the pixel data that has been rearranged for each pass, thereby forming dots in pixels on the paper to print an image (S111).

Color Irregularity Correction Processing

Figure 18:
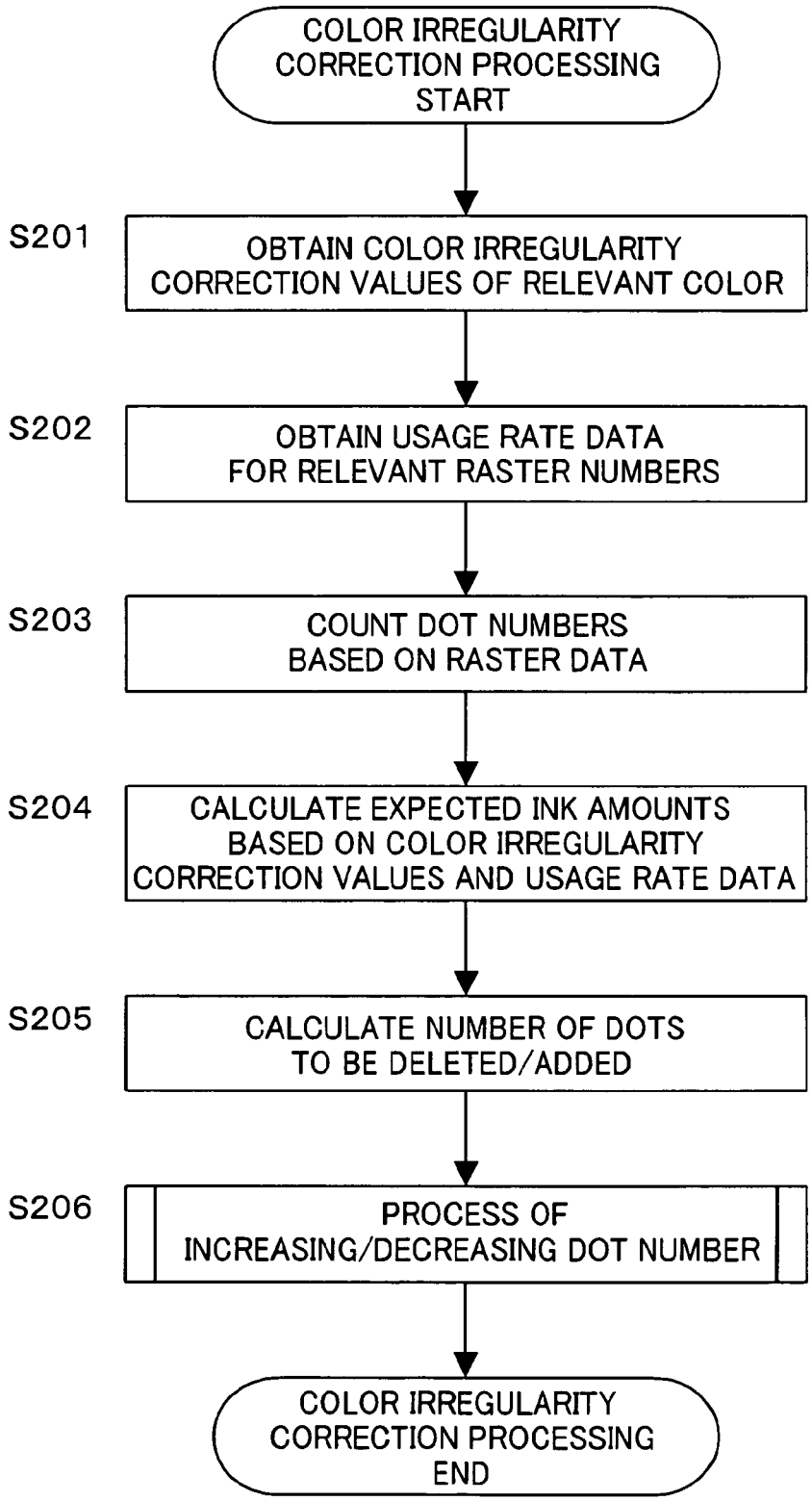
FIG. 18 is a flowchart of color irregularity correction processing according to a first embodiment.

FIG. 18 is a flowchart of color irregularity correction processing according to a first embodiment.

First, the controller 60 obtains color irregularity correction values for the relevant color (S201). For example, when carrying out color irregularity correction processing on raster data of cyan image data, color irregularity correction values of cyan are obtained. At this time, the controller 60 also obtains both color irregularity correction values for the first nozzle row 42A and color irregularity correction values for the second nozzle row 42B. Here, description is given of the color irregularity correction values shown in FIG. 19 obtained by the controller 60.

Next, based on the usage rate table (see FIG. 13), the controller 60 obtains (S202) data of usage rates of raster numbers corresponding to the raster data extracted at S107. Supposing that the raster line corresponding to the raster data belongs to the upper end region, then the usage rate of the first nozzle row 42A is 1 (100%), and the usage rate of the second nozzle row 42B is 0 (0%). Furthermore, if the raster line corresponding to the raster data belongs to the ordinary region, then the usage rate of the first nozzle row 42A is 0.5 (50%), and the usage rate of the second nozzle row 42B is also 0.5 (50%). A relationship between the raster number and the usage rate is determined uniquely once the dot forming method is determined.

It should be noted that in the present embodiment there is the transition region between the upper end region and the ordinary region, and in the transition region, raster lines are present whose usage rate of the first nozzle row 42A is between 0.5 to 1. For example, a raster line whose usage rate of the first nozzle row 42A is 0.75 (75%) is present in the transition region.

As described above, once the raster number is determined, the usage rates of the nozzle rows are determined uniquely, but in FIG. 20 and FIG. 21, which are described later, the usage rates of the first nozzle row 42A are listed in intervals of 0.1 from 0.5 to 1.

Next, the controller 60 analyzes the raster data and counts the number of pixel data indicating large dots, medium dots, and small dots respectively (S203). Here, to simplify description, there are 10,000 dots of each size.

Next, based on the color irregularity correction values and the usage rate data, the controller 60 calculates expected ink amounts, which are expected values of the ink amounts to be ejected (S204).

FIG. 20 is an explanatory diagram of expected ink amounts. The controller 60 first calculates expected characteristics, which are expected values of raster line characteristics. The expected characteristics are calculated as values in which the color irregularity correction values are weighted by nozzle row usage rates. The controller 60 calculates expected characteristics of large dots, medium dots, and small dots respectively. For example, when a usage rate of the first nozzle row 42A by a certain raster line is 0.7, a small dot expected characteristic is calculated as 97.4% (=95%×0.7+103%×0.3). Next, the controller 60 calculates expected ink amounts based on the expected characteristics. The expected ink amounts are calculated using a product of the standard amount and the expected characteristic. The controller 60 calculates expected ink amounts of large dots, medium dots, and small dots respectively. For example, when an expected characteristic of a small dot in a certain raster line is 97.4%, since the standard amount is 5 ng, the expected ink amount is calculated as 4.87 ng (=5 ng×0.974).

Next, based on the counted dot numbers and the expected ink amounts, the controller 60 calculates the number of dots to be deleted or added (S205).

FIG. 21 is an explanatory diagram of dot numbers to be deleted or added. Here description is given regarding a case where the expected ink amount of a small dot (standard amount 5 ng) is 4.87 ng (when the usage rate of the first nozzle row 42A is 0.7).

Normally, 10,000 small dots should be formed in this raster line, but since the expected ink amount is smaller than the standard amount which is 4.87 ng, if only the 10,000 small dots were to be formed, then the ink amount ejected in that raster line would become smaller. On the other hand, even though the expected ink amount is 4.87 ng, if 10,267 small dots are formed, then the ink amount ejected in that raster line becomes substantially equivalent to the ink amount intended to be ejected (50,000 ng). Accordingly, the controller 60 determines to add 267 small dots to the small dots that form that raster line. That is, the controller 60 forms dots in the number obtained by "standard amount×count number÷expected ink amount" in that raster line. In other words, the controller 60 increases/decreases the number of dots corresponding to a value in which the "count number" is subtracted from "standard amount×count number÷expected ink amount". The controller 60 carries out the same calculations not only for small dots but for medium dots and large dots as well, and calculates the number of dots to be deleted or added.

Next, the controller 60 carries out a process of increasing/decreasing the number of dots (S206). The process of increasing/decreasing the number of dots is a process in which the number of pixel data indicating that a dot is to be formed is increased/decreased.

Figure 22:
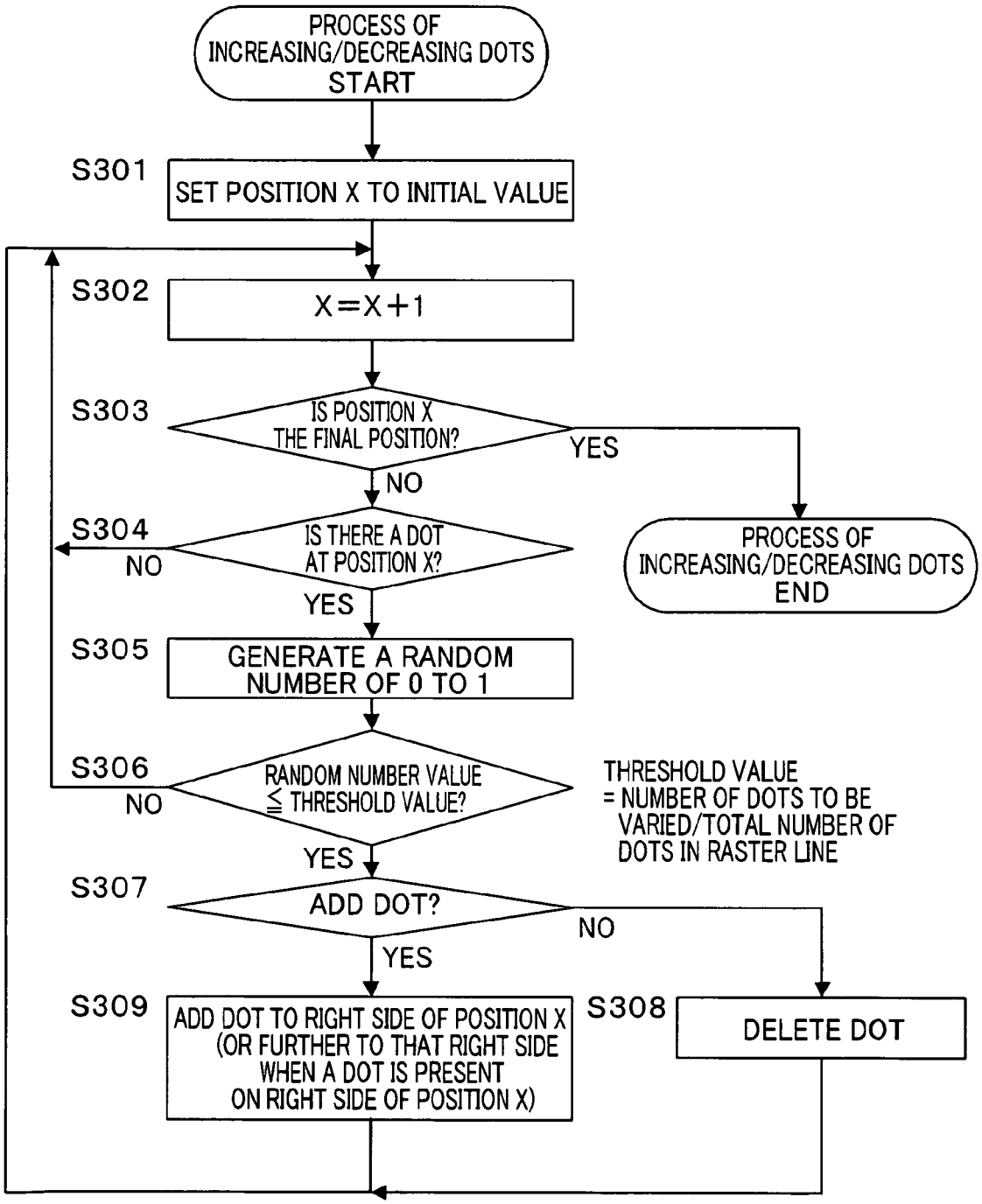
FIG. 22 is a flowchart of a process of increasing/decreasing the number of dots.

FIG. 22 is a flowchart of the process of increasing/decreasing the number of dots. The controller 60 carries out the process in FIG. 22 of increasing/decreasing the number of dots first for the small dots, then after the process of increasing/decreasing the number of dots for the small dots, carries out the process of increasing/decreasing the number of dots in order of medium dots, large dots.

First, the controller 60 sets a position X to an initial value (S301). It should be noted that the position X is a value indicating a position of a pixel in the raster line (a position of a pixel of interest). Here, larger values of the position X are positioned further to the right side. And at S302, the position X is a value indicating a position of a left end of the raster line. The determination at S303 is initially "NO".

Next, the controller 60 determines whether or not there is a dot in the position X (S304). In other words, the controller 60 determines whether or not the tone value (four tones) of the pixel data corresponding to the pixel of interest is a value indicating dot formation. It should be noted that in the case where a small dot is to be increased/decreased for example, a determination is made as to whether or not there is a small dot in the position X. When there is no dot in the position X (NO at S304), then the procedure returns to S302 and the position X is incremented by 1 (the pixel of interest becomes a pixel one place to the right). When there is a dot in the position X (YES at S304), the controller 60 generates a random number in the range of 0 to 1.

After generating the random number, the controller 60 determines whether or not the random number is a threshold value or less (S306). It should be noted that the threshold value is a value in which the number of dots to be varied (number of dots to be deleted or added) is divided by the total number of dots in the raster line (count value). That is, when this process of increasing/decreasing the number of dots is carried out on certain raster data, the number of times "YES" is determined at S306 becomes substantially equivalent to the number of dots to be varied.

Next, the controller 60 determines whether the dot is to be added or deleted (S307). If the number of dots shown in FIG. 21 is negative, then the controller 60 determines "NO", and if it is positive, then "YES" is determined.

When it is determined to delete a dot (NO at S307), the controller 60 deletes the dot at the position X (S308). In other words, the controller 60 varies the tone value of the pixel data corresponding to the pixel of interest to a tone value indicating no dot.

Figure 23A:
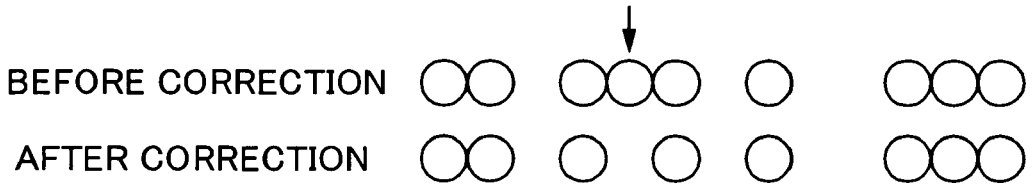
FIG. 23A is an explanatory diagram of a result of a dot being deleted.

FIG. 23A is an explanatory diagram of a result of a dot being deleted. In order to simplify description here, the dots that constitute the raster line are all set to dots of the same size. The arrow in FIG. 23A indicates the position of the pixel of interest. As shown in FIG. 23A, by deleting the dot, correction is performed such that the amount of ink ejected when forming the raster line is reduced. As a result, the raster line, which would have been formed dark if there had been no correction, is corrected to become lighter, and the density of the raster line can be made closer to a targeted density.

It should be noted that since the position of the dot to be deleted is determined by a random number in the present embodiment, the position where the dot is to be deleted is random, and therefore the position of the dot to be deleted is unbiased. For this reason, with the present embodiment, compared to a case where the position of the dot to be deleted is biased, the picture quality after correction is improved.

When it is determined to add a dot (YES at S307), the controller 60 adds a dot to the right side of the position X (S309). In other words, the controller 60 varies the tone value of the pixel data corresponding to a pixel on the right side of the pixel of interest to a tone value indicating a small dot if a small dot is to be added. It should be noted that in the case where there is already a dot present on the right side of the position X, the controller 60 adds the dot further to the right side.

Figure 23B:
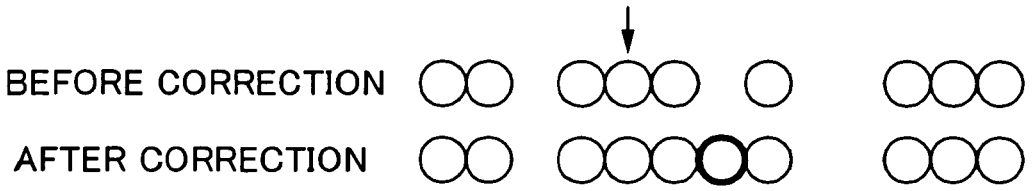
FIG. 23B is an explanatory diagram of a result of a dot being added.

FIG. 23B is an explanatory diagram of a result of a dot being added. The arrow in FIG. 23B indicates the position of the pixel of interest and the dot shown by a bold line in FIG. 23B indicates an added dot. As shown in FIG. 23B, by adding the dot, correction is performed such that the amount of ink ejected when forming the raster line is increased. As a result, the raster line, which would have been formed light if there had been no correction, is corrected to become darker, and the density of the raster line can be made closer to a targeted density.

It should be noted that since the position of the dot to be added is determined by a random number in the present embodiment, the position where the dot is to be added is random, and therefore the position of the dot to be added is unbiased. In this way, with the present embodiment, compared to a case where the position of the dot to be added is biased, the picture quality after correction is improved.

Furthermore, with the present embodiment, the dot is added neighboring on the right side using as a reference a position where a dot is already present before correction. That is, the added dot is formed close to a position where there is already a dot, and is not formed in a position where no dot is present. In this way, it is possible to avoid adding a dot to a position where it is undesirable to form a dot (for example, a white color portion of an image).

Further still, with the present embodiment, positions where dots are to be added are determined randomly using as a reference a position where a dot is already present before correction. As a result, with the present embodiment, when a plurality of dots are to be added, more dots are added for locations where dots are concentrated. In this way, dots can be added without impairing the darkness/lightness of the image before correction. Suppose that positions where dots are to be added were determined randomly from among all the pixels in the raster line rather than using as a reference positions where dots are present, dots would be added evenly with no regard to conditions of dot concentration, and therefore there is a risk that the darkness/lightness of the image before correction would be impaired. Furthermore, suppose that positions where dots are to be added were determined randomly from among positions where there are no dots, then many dots would be added undesirably to light areas of the image, which would result in deteriorated picture quality.

After the process of S308 and the process of S309, the controller 60 returns to the process of S302. Then, the controller 60 repeats the above-described processing (S302 to S309) until the position of the pixel of interest becomes a final position (right end position). Then, when the position of the pixel of interest is at the final position (YES at S303), the controller 60 finishes the process of increasing/decreasing the number of dots for that raster line (S206) and finishes color irregularity correction processing.

Result of Color Irregularity Correction Processing

Here, description is given of examples of effects of color irregularity correction processing in which an ink amount larger than the standard amount is ejected from the first nozzle row 42A and an ink amount smaller than the standard amount is ejected from the second nozzle row 42B.

As described earlier, in the upper end region, raster lines are formed by only the first nozzle row 42A. For this reason, if color irregularity correction processing is not carried out, then the upper end region will have a picture quality that reflects the characteristics of the first nozzle row 42A as it is, resulting in a dark image. On the other hand, when color irregularity correction processing is carried out (S108), then dots that constitute raster lines belonging to the upper end region are deleted. As a result, if dots are formed in accordance with the corrected pixel data (four tones), then the amount of ink ejected in the raster line will be corrected to be smaller, and the image can be printed in the upper end region with a density of tone values indicated by the original pixel data (256 tones).

In the ordinary region and the transition region, the tone values (four tones) are corrected giving consideration to the usage rates of the nozzle rows. That is, the controller 60 calculates the expected ink amounts giving consideration to the usage rate of the nozzle rows in each raster line, and adds or deletes dots that constitute the raster lines based on the expected ink amounts. In this way, the amount of ink ejected in the raster line is corrected, and the image can be printed with a density of tone values indicated by the original pixel data (256 tones).

Incidentally, when the above-described color irregularity correction processing has been carried out, although color irregularity is improved, color irregularity cannot be completely corrected (even if color irregularity can be corrected theoretically, color irregularity could not be completely corrected in tests using an actual apparatus). That is, the density of tone values indicating the pixel data (256 tones) before correction and the density of the image that is actually printed are not perfectly matched.

Figure 24A:
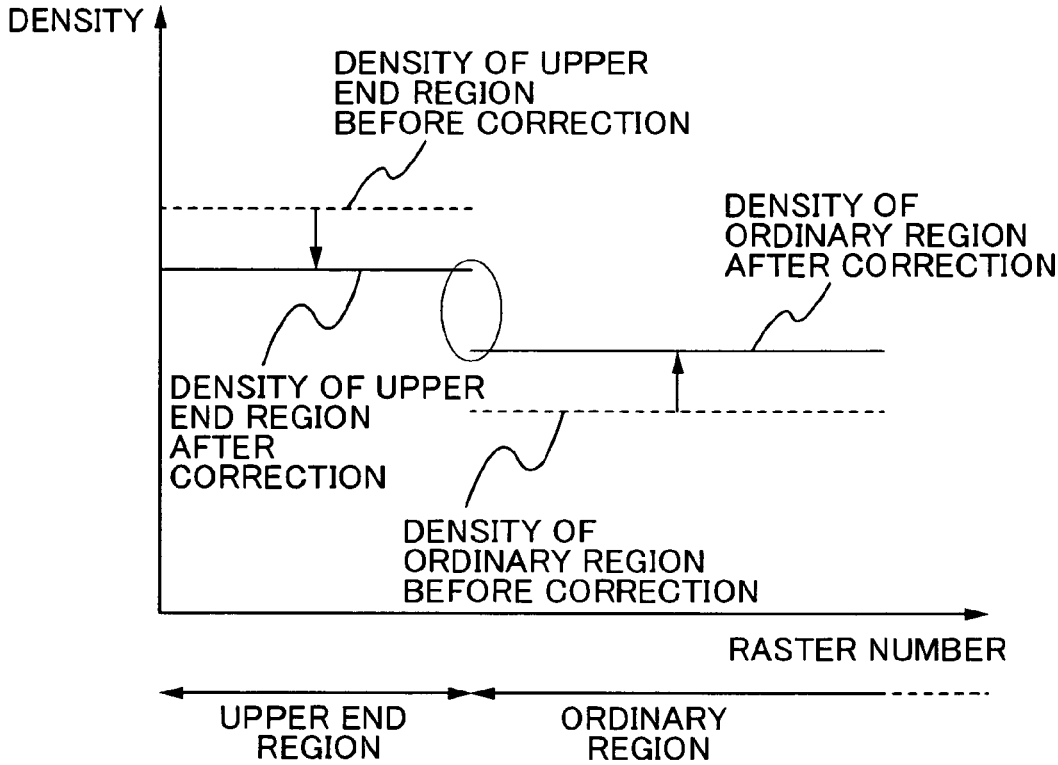
FIG. 24A is an explanatory diagram of a comparative example of a case in which color irregularity cannot be perfectly corrected.
Figure 24B:
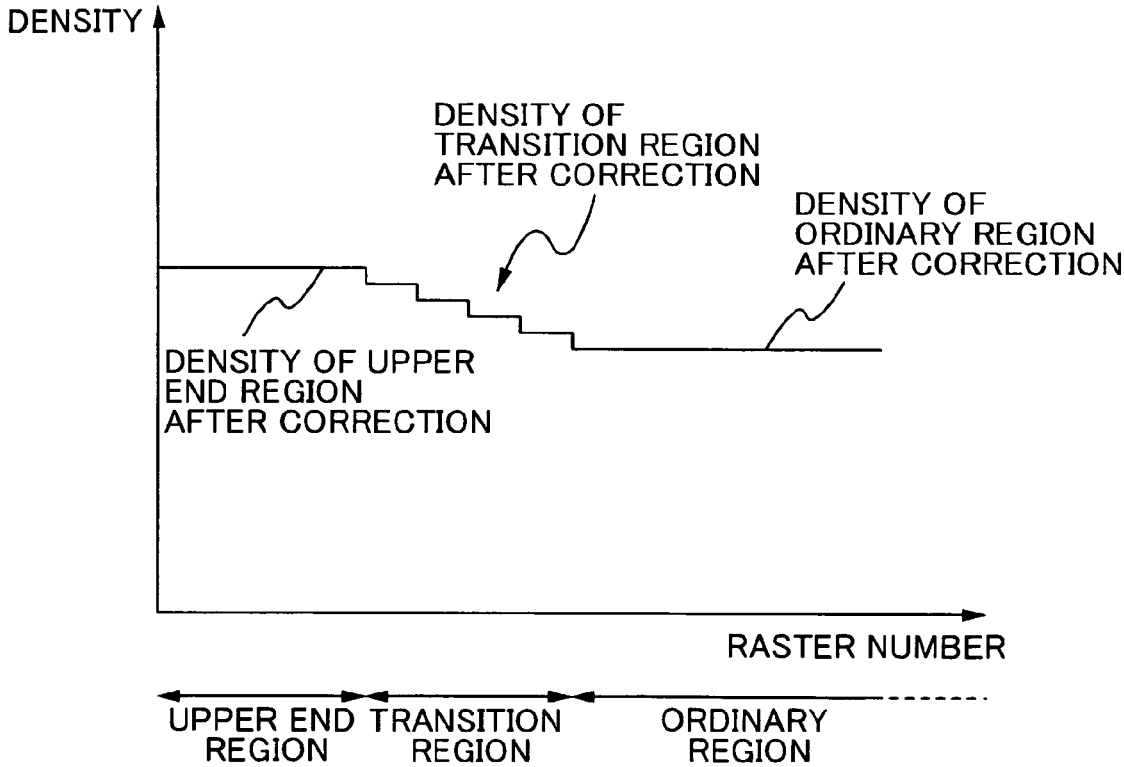
FIG. 24B is an explanatory diagram of the present embodiment for a case in which color irregularity cannot be perfectly corrected.

FIG. 24A is an explanatory diagram of a comparative example of a case in which color irregularity cannot be perfectly corrected. FIG. 24B is an explanatory diagram of the present embodiment for a case in which color irregularity cannot be perfectly corrected. In these diagrams, the horizontal axes indicate the raster number and the vertical axes indicate density. In the comparative example, a dot forming method different from the present embodiment is carried out and there is no transition region.

In both FIG. 24A and FIG. 24B, the result of color irregularity correction processing being carried out is that the difference becomes smaller between the density of the upper end region and the density of the ordinary region. Thus, due to the color irregularity correction processing, the difference between the picture quality of the upper end region and the picture quality of the ordinary region tends not to become conspicuous.

However, in the comparative example, although the difference in density is improved, sudden change in density occurs at the joining area between the upper end region and the ordinary region since there is no transition region. When sudden change in density occurs in this manner, the difference between the picture quality of the upper end region and the picture quality of the ordinary region tends to become visible undesirably.

On the other hand, in the present embodiment, a transition region is formed, and in the transition region there are raster lines having an intermediate character of the upper end region and the ordinary region (for example, a raster line whose usage rate of the first nozzle row 42A is 75%). Further still, by causing the manner of using overlapping nozzles in upper end processing and transition processing to be different from the manner of using overlapping nozzles in ordinary processing, the usage rates in the transition region can be caused to change gradually. As a result, for the raster lines in the transition region, the usage rates of the first nozzle row 42A in raster lines closer to the upper end region are values closer to 100%, and the usage rates of the first nozzle row 42A in raster lines closer to the ordinary region are values closer to 50%.

When the above-described color irregularity correction processing is carried out when performing printing in which a transition region is formed in this manner, a density distribution is achieved as shown in FIG. 24B.

As shown in FIG. 24B, the densities in the transition region are intermediate densities of the density of the upper end region and the density of the ordinary region. Furthermore, in the transition region, the densities are closer to the density of the upper end region when closer to the upper end region and the densities are closer to the density of the ordinary region when closer to the ordinary region, such that the densities change gradually.

In this manner, with the present embodiment, even if color irregularity cannot be perfectly corrected using color irregularity correction processing, locations where sudden change in density occur are eliminated, and therefore the change in density becomes hardly visible. As a result, the image quality of the printed image is improved.

Color Irregularity Corrections of Second Embodiment

In the color irregularity corrections of the first embodiment, dots were deleted and dots were added in locations where there was no dot. On the other hand, in a second embodiment, rather than deletion or addition of dots, the amount of ink to be ejected is corrected by varying the size of the dots, thereby correcting color irregularities. In the second embodiment, of the processes during printing in the first embodiment, the content of color irregularity correction processing in FIG. 17 (S108) is different. Other processes (for example, resolution conversion processing and the like) are substantially the same as in the first embodiment, and therefore description thereof is omitted here.

Figure 25:
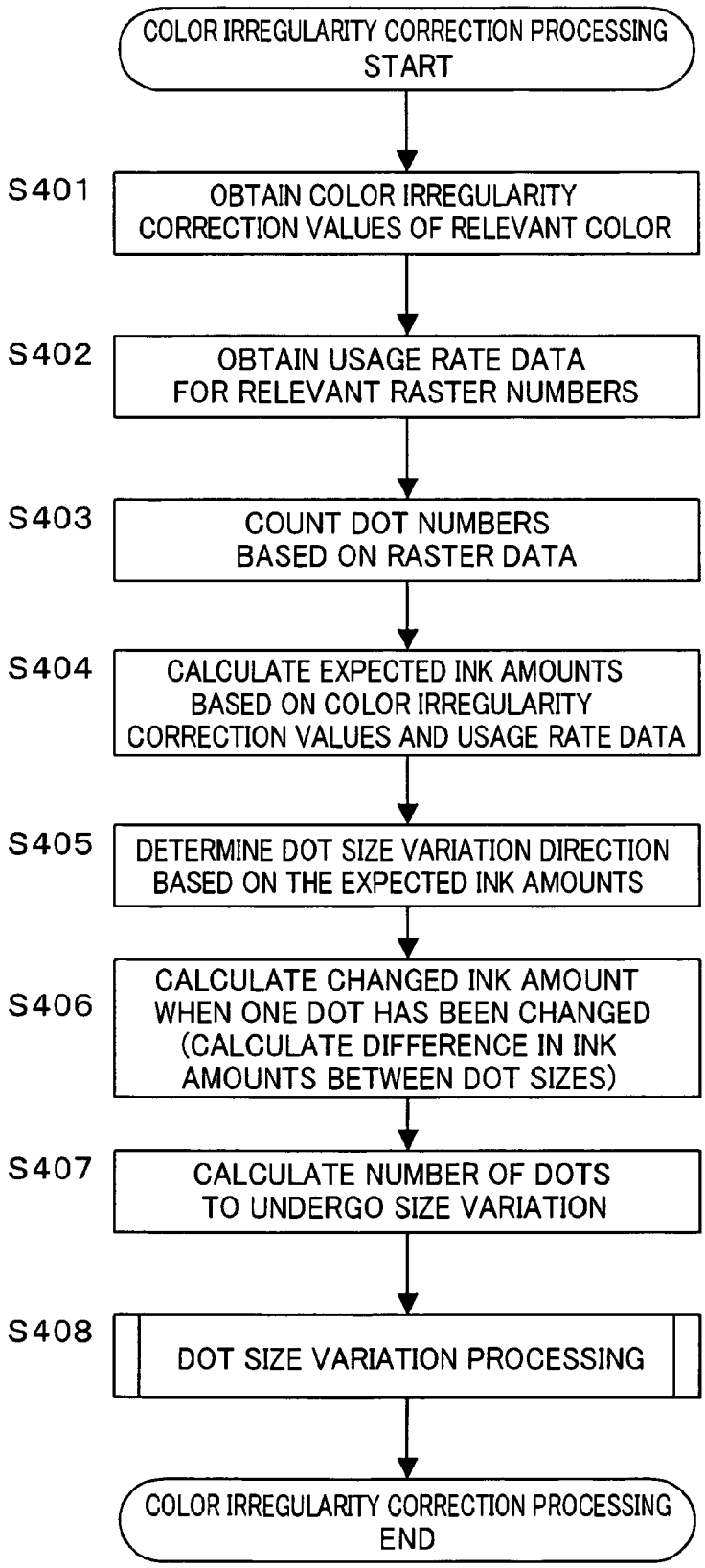
FIG. 25 is a flowchart of color irregularity correction processing according to a second embodiment.

FIG. 25 is a flowchart of color irregularity correction processing according to the second embodiment. The processes of S410 to S404 in FIG. 25 are the same processes as S201 to S204 in FIG. 18 of the first embodiment, and therefore description thereof is omitted.

After the expected ink amounts are calculated, the controller 60 determines a dot size variation direction based on the expected ink amounts (S405).

FIG. 26 is a comparative table of dot size variation directions. For example, if the expected ink amount of a large dot is greater than a standard amount (20 ng), then the controller 60 determines that the large dot is to be changed to a medium dot. Furthermore, for example, if the expected ink amount of a medium dot is smaller than a standard amount (10 ng), then the controller 60 determines that the medium dot is to be changed to a large dot. It should be noted that in the case where the expected ink amount of a large dot is smaller than a standard amount (20 ng), since there is no dot larger than a large dot, the controller 60 determines to add a large dot rather than changing the size of the large dot. Similarly, in the case where the expected ink amount of a small dot is larger than a standard amount (5 ng), since there is no dot smaller than a small dot, the controller 60 determines to delete the small dot rather than changing the size of the small dot.

Next, the controller 60 calculates an amount of change in the ink amount (changed ink amount) when the size of one dot has been changed (S406). In other words, the controller 60 calculates differences in the ink amounts between the dot sizes respectively.

FIG. 27 is an explanatory diagram of changed ink amounts. When there is a change from a large dot to a medium dot, or when there is a change from a medium dot to a large dot, the changed ink amount is calculated as a difference between the expected ink amount of the large dot and the expected ink amount of the medium dot. Furthermore, when there is a change from a medium dot to a small dot, or when there is a change from a small dot to a medium dot, the changed ink amount is calculated as a difference between the expected ink amount of the medium dot and the expected ink amount of the small dot. It should be noted that when a large dot is added, the changed ink amount is the expected ink amount of the large dot. Also, when a small dot is deleted, the changed ink amount is the expected ink amount of the small dot.

Next, the controller 60 calculates the number of dots whose dot size is to be changed (number of dots to be varied) (S407). Here, description is given using as an example a case in which the nozzle row characteristics are as shown in FIG. 19 and the usage rate of the first nozzle row is 0.7 (the expected ink amount of a small dot is 4.87 ng, the expected ink amount of a medium dot is 10.12 ng, and the expected ink amount of a large dot is 19.88 ng).

FIG. 28 shows an example of calculating the number of dots to be varied. Here, to simplify description, the count value at S403 is 10,000 dots for each size of dot.

Normally, 10,000 small dots should be formed in this raster line, but since the expected ink amount is smaller than the standard amount at 4.87 ng, if only the 10,000 small dots were to be formed, then the ink amount ejected in that raster line would become smaller. On the other hand, even though the expected ink amount is 4.87 ng, if 248 of the 10,000 small dots are changed to medium dots, then the ink amount ejected in that raster line becomes substantially equivalent to the ink amount intended to be ejected (50,000 ng). Accordingly, the controller 60 determines to vary 248 of the 10,000 small dots that form that raster line to medium dots. That is, the controller 60 changes small dots in a number corresponding to a value in which "(standard amount−expected ink amount)× count value" is divided by the "changed ink amount" into medium dots. The controller 60 carries out the same calculations not only for small dots but for medium dots and large dots as well, and calculates the number of dots to be changed from medium dots to small dots and the number of dots of large dots to be added.

Next, the controller 60 carries out dot size variation processing (S408). Dot size variation processing is a process in which tone values of pixel data indicating that a dot of a predetermined size is to be formed are changed to tone values of pixel data indicating that a dot of a different size is to be formed.

Figure 29:
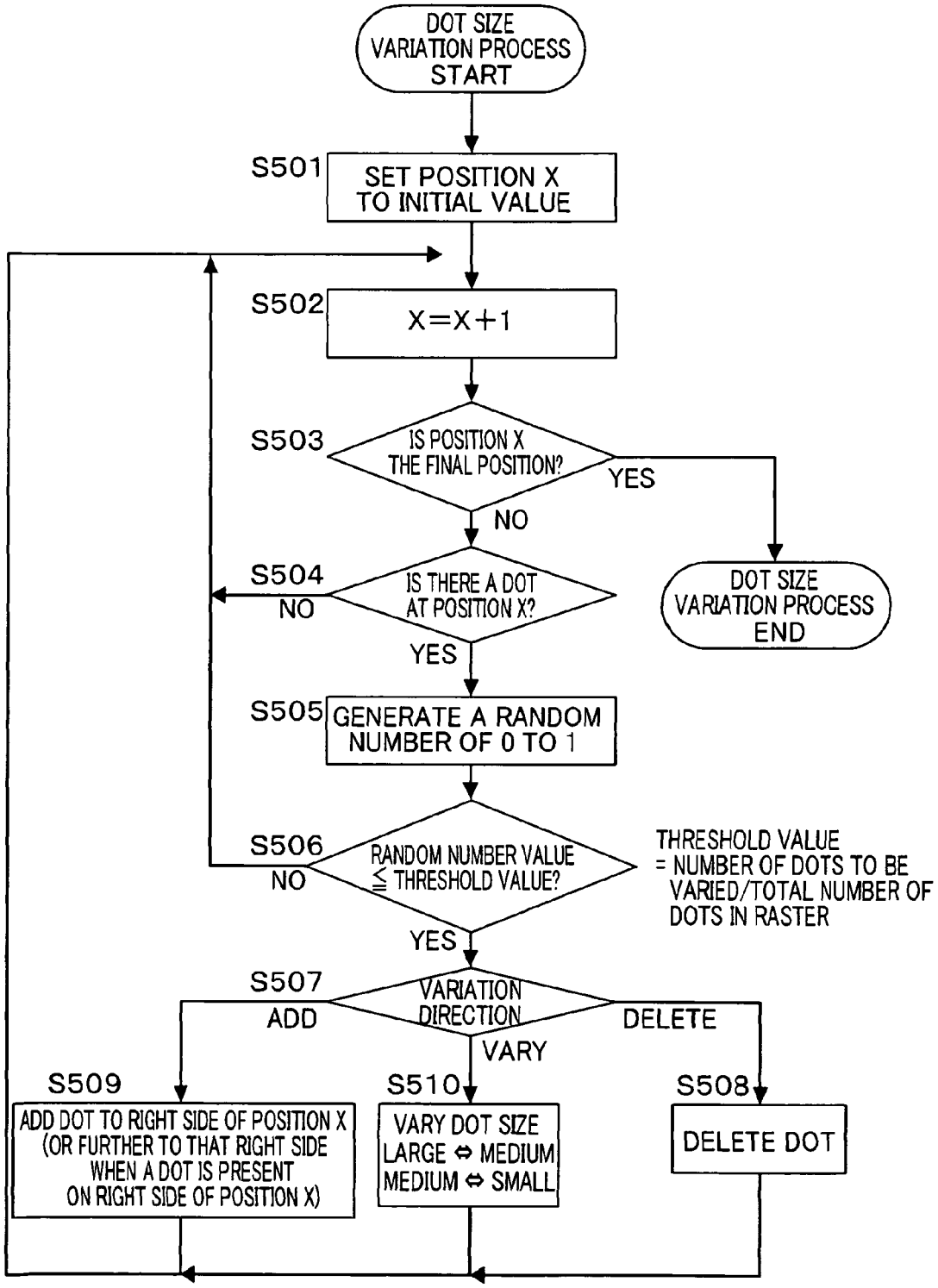
FIG. 29 is a flowchart of dot size variation processing.

FIG. 29 is a flowchart of dot size variation processing. The controller 60 first carries out dot size variation processing in FIG. 29 for the small dots, then after dot size variation processing for the small dots, carries out dot size variation processing in order for medium dots and large dots.

First, the controller 60 sets a position X to an initial value (S501) It should be noted that the position X is a value indicating a position of a pixel in the raster line (a position of a pixel of interest). Here, larger values of the position X are positioned further to the right side. Then, at S502, the position X is a value indicating a position of a left end of the raster line. The determination at S503 is initially "NO".

Next, the controller 60 determines whether or not there is a dot in the position X (S504). In other words, the controller 60 determines whether or not the tone value (four tones) of the pixel data corresponding to the pixel of interest is a value indicating dot formation. It should be noted that in the case where dot size variation processing is carried out on small dots, a determination is made as to whether or not there is a small dot in the position X. When there is no dot in the position X (NO at S504), then the procedure returns to S502 and the position X is incremented by 1 (the pixel of interest becomes a pixel one place to the right). When there is a dot in the position X (YES at S504), the controller 60 generates a random number in a range of 0 to 1.

After generating the random number, the controller 60 determines whether or not the random number is a threshold value or less (S506). It should be noted that the threshold value is a value in which the number of dots to be varied is divided by the total number of dots in the raster line (count value). That is, when the dot size variation processing is carried out on certain raster data, the number of times "YES" is determined at S506 becomes substantially equivalent to the number of dots to be varied.

Next, the controller 60 determines a dot size variation direction (S507). At this time, the controller 60 carries out the determination based on the variation directions determined at S405 in FIG. 25.

When it is determined to delete a dot, the controller 60 deletes the dot at the position X (S508). In other words, the controller 60 changes the tone value of the pixel data corresponding to the pixel of interest to a tone value indicating no dot. As a result, correction is performed such that the amount of ink to be ejected when forming the raster line is reduced, and the raster line, which would have been formed dark if there had been no correction, can be corrected to become lighter, and the density of the raster line can be made closer to a targeted density.

Furthermore, when it is determined to add a dot, the controller 60 adds a dot to the right side of the position X (S509). In other words, the controller 60 varies the tone value of the pixel data corresponding to the pixel on the right side of the pixel of interest to a tone value indicating a large dot. It should be noted that in the case where there is already a dot present on the right side of the position X, the controller 60 adds the large dot further to the right side. As a result, correction is performed such that the amount of ink to be ejected when forming the raster line is increased, and the raster line, which would have been formed light if there had been no correction, can be corrected to become darker, and the density of the raster line can be made closer to a targeted density.

Furthermore, when it is determined to vary the dot size, the controller 60 varies the size of the dot at the position X (S510). In other words, the controller 60 varies the tone value of the pixel data corresponding to the pixel of interest to a tone value indicating a dot of a different size. For example, in the case of FIG. 28, when dot size variation processing is carried out on small dots, some of the small dots are changed to medium dots. As a result, correction is performed such that the amount of ink to be ejected when forming the raster line is increased, and the raster line, which would have been formed light if there had been no correction, can be corrected to become darker, and the density of the raster line can be made closer to a targeted density. Furthermore, in the case of FIG. 28, when dot size variation processing is carried out on medium dots, some of the medium dots are changed to small dots. As a result, correction is performed such that the amount of ink to be ejected when forming the raster line is reduced, and the raster line, which would have been formed dark if there had been no correction, can be corrected to become lighter, and the density of the raster line can be made closer to a targeted density.

Compared to the first embodiment, the granularity of the image is improved in the second embodiment. In the first embodiment, there is a large change in the density (ink amount) before and after corrections when focusing on a single pixel. For example, supposing a case where the expected ink amount of a large dot is large, according to the first embodiment, the amount of ink to be ejected at a certain pixel is reduced by approximately 20 ng, which unfortunately results in sudden decrease of the density of that pixel. On the other hand, according to the second embodiment, a medium dot is formed instead of a large dot, and the amount of ink to be ejected at that pixel is reduced by only approximately 10 ng, and therefore the amount of change in the density of that pixel is reduced and there is less impairment to the darkness/lightness of the image before correction, compared to the first embodiment.

After the processing of any of S508 to S510, the controller 60 returns to the process of S502. Then, the controller 60 repeats the above-described processing (S502 to S510) until the position of the pixel of interest becomes a final position (right end position). Then, when the position of the pixel of interest is at the final position (YES at S503), the controller 60 finishes the dot size variation processing for that raster line (S406) and finishes color irregularity correction processing.

Different Embodiments

Figure 30:
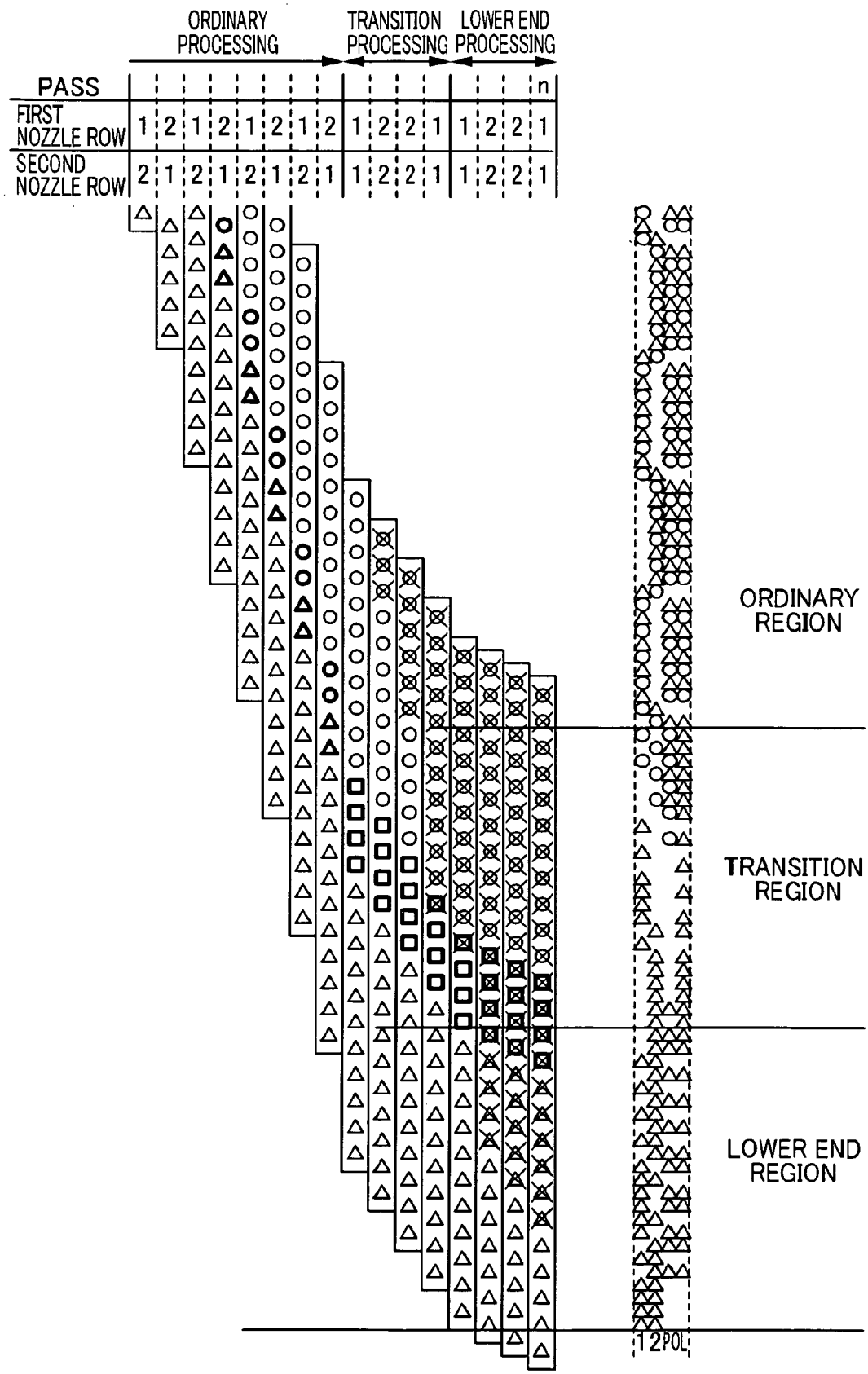
FIG. 30 is an explanatory diagram of a different dot forming method.

FIG. 30 is an explanatory diagram of a different dot forming method. Here, a state of dot forming is shown when lower end processing is carried out for printing a lower end of the paper after ordinary processing has been carried out. The dot forming method carried out for the lower end can be understood by viewing FIG. 30, and therefore detailed description thereof is omitted.

In this manner, a dot forming method that is substantially equivalent to the dot forming method carried out on the upper end side as described above may be carried out on the lower end side. In this way, the same effect as the effect achieved for the upper end side can be also achieved for the lower end side.

Other Embodiments

The foregoing embodiments mainly describe a printer. However, it goes without saying that it also includes the disclosure of printing apparatuses, recording apparatuses, liquid ejecting apparatuses, printing methods, recording methods, liquid ejection methods, printing systems, recording systems, computer systems, programs, storage media having a program stored thereon, display screens, screen display methods, and methods for producing printed material, for example.

Furthermore, although description was given of a printer as an embodiment of the invention, the foregoing embodiments are for the purpose of elucidating the invention and are not to be interpreted as limiting the invention. The invention can of course be altered and improved without departing from the gist thereof and includes functional equivalents. In particular, embodiments described below are also included in the invention.

Regarding the Printer

A printer was described in the foregoing embodiments, but there is no limitation to this. For example, the same technology as that of the present embodiment can also be applied to various types of liquid ejecting apparatuses that employ inkjet technology, including color filter manufacturing apparatuses, dyeing apparatuses, micro-processing apparatuses, semiconductor manufacturing apparatuses, surface processing apparatuses, three-dimensional shape forming machines, liquid vaporizing apparatuses, organic EL manufacturing apparatuses (in particular, macromolecular EL manufacturing apparatuses), display manufacturing apparatuses, film formation apparatuses, and DNA chip manufacturing apparatuses. Also these methods and manufacturing methods are within the scope of application. Also when applying the present technology to fields such as these, the characteristic that liquid can be directly ejected (written) to a target object allows a reduction in material, process steps, and costs compared to conventional cases.

Regarding the Ink

The foregoing embodiments were embodiments of a printer, and therefore a dye ink or a pigment ink was ejected from the nozzles. However, the liquid that is ejected from the nozzles is not limited to such inks. For example, it is also possible to eject from the nozzles a liquid (including water) including metallic material, organic material (particularly macromolecular material), magnetic material, conductive material, wiring material, film-formation material, electronic ink, processed liquid, and genetic solutions. A reduction in material, process steps, and costs can be achieved if such liquids are directly ejected toward a target object.

Regarding the Nozzles

In the foregoing embodiments, ink was ejected using piezoelectric elements. However, the method for ejecting liquid is not limited to this. For example, other methods, such as a method for generating bubbles in the nozzles through heat, may also be employed.

Regarding the Number of the Nozzle Rows

In the foregoing embodiments, the number of nozzle groups (nozzle rows) was two, but there may be three or more. Even when there are three or more nozzle groups, if upper end processing and ordinary processing are carried out, an upper end region, in which dots are formed by a single nozzle group only, and an ordinary region, in which dots are formed by a plurality of nozzle groups become present. And when there are three or more nozzle groups, if processing equivalent to the foregoing embodiments is carried out, then the difference in picture quality between the upper end region and the ordinary region will tend not to become conspicuous.

Regarding Processing by the Controller

In the foregoing embodiments, color correction processing was carried out on the printer side. However, there is no limitation to this, and color correction processing may be carried out on the printer driver side. However, since color correction processing is carried out focusing on the manner of dot arrangement, it is preferable that color correction processing is carried out after halftone processing. In this way, color correction processing can be carried out without depending on the technique of halftone processing.

What is claimed is:

1. A liquid ejecting method, comprising:

varying dots that are to constitute a dot row that is to be formed with a first nozzle row and a second nozzle row, according to a usage rate of each of the first and second nozzle rows when forming that dot row, the first nozzle row including a plurality of first nozzles lined up in a transport direction, the second nozzle row including a plurality of second nozzles in the transport direction, the first nozzles of the first nozzle row forming dots on a medium by ejecting liquid while moving in a movement direction, the second nozzles of the second nozzle row forming dots on the medium by ejecting liquid while moving in the movement direction, the dot row that has been formed on the medium being composed of a plurality of the dots to be lined up on the medium in the movement direction; and forming a plurality of the dot rows in the transport direction by alternately repeating a transport operation of transporting the medium in the transport direction and a dot forming operation of forming a dot on the medium by ejecting liquid from the first nozzles and the second nozzles while the first and second nozzles moving in the movement direction, at least one of the dot rows that have been formed by the first and second nozzles being composed of the dots that are varied according to the usage rate of each of the first nozzle row and the second nozzle row.

2. A liquid ejecting method according to claim 1, wherein in the case of varying the dots that are to constitute the dot row, a dot is added to a position neighboring a position of the dots that are to constitute the dot row.

3. A liquid ejecting method according to claim 1, wherein in the case where a plurality of dots are to be added in varying the dots that are to constitute the dot row, a plurality of positions in which dots are to be added are determined, based on a position that is randomly selected among positions of the plurality of dots that are to constitute the dot row.

4. A liquid ejecting method according to claim 1, wherein the first nozzle row and the second nozzle row can respectively form a plurality of sizes of dots, and in varying the dots that are to constitute the dot row, a size of a dot to be formed is varied.

5. A liquid ejecting method according to claim 1, wherein first correction values that indicate a liquid amount to be ejected from the first nozzles and second correction values that indicate a liquid amount to be ejected from the second nozzles are set in advance;

in forming a dot row using the first nozzle row and the second nozzle row, an expected value of a liquid amount to be ejected in order to form a dot that is to constitute that dot row is calculated based on a usage rate of each of the first and second nozzle rows when forming that dot row, a usage rate of the first nozzle row, and the first and second correction values; and the number of the dots that are to constitute that dot row is varied based on the expected values.

6. A liquid ejecting method according to claim 1, wherein the liquid ejecting method further includes a first process of alternately repeating the dot forming operation and the transport operation of transporting the medium by a first transport amount, a second process of alternately repeating the dot forming operation and the transport operation of transporting the medium by a second transport amount that is shorter than the first transport amount, and a third process of alternately repeating the dot forming operation and the transport operation of transporting the medium in a first direction by a third transport amount that is shorter than the first transport amount and longer than the second transport amount, the third process being carried out between the first process and the second process, in a dot row of a first region on the medium, a ratio of the number of dots formed by the first nozzles with respect to the number of dots formed by the second nozzles is a predetermined ratio, in a dot row of a second region on the medium, no dot is formed by the second nozzles, and the dot row is constituted by dots formed by the first nozzles, and a third region between the first region and the second region includes a dot row in which a ratio of the number of dots formed by the first nozzles with respect to the number of dots formed by the second nozzles is higher than the predetermined ratio.

7. A liquid ejecting apparatus, comprising:

a transport section for transporting a medium in a transport direction;

a first nozzle row including a plurality of first nozzles lined up in the transport direction;

a second nozzle row including a plurality of second nozzles in the transport direction; and a controller that varies dots that are to constitute a dot row that is to be formed with the first nozzle row and the second nozzle row, according to a usage rate of each of the first and second nozzle rows when forming that dot row, the first nozzles of the first nozzle row forming dots on a medium by ejecting liquid while moving in a movement direction, the second nozzles of the second nozzle row forming dots on the medium by ejecting liquid while moving in the movement direction, the dot row that has been formed on the medium being composed of a plurality of the dots to be lined up on the medium in the movement direction; and that forms a plurality of the dot rows in the transport direction by alternately repeating a transport operation of transporting the medium in the transport direction and a dot forming operation of forming a dot on the medium by ejecting liquid from the first nozzles and the second nozzles while the first and second nozzles moving in the movement direction, at least one of the dot rows that have been formed by the first and second nozzles being composed of the dots that are varied according to the usage rate of each of the first nozzle row and the second nozzle row.

8. A storage medium having a program stored thereon, the program comprising:

enabling a liquid ejecting apparatus that includes a transport section for transporting a medium in a transport direction, a first nozzle row including a plurality of first nozzles lined up in the transport direction, and a second nozzle row including a plurality of second nozzles in the transport direction, to realize a function to vary dots that are to constitute a dot row that is to be formed with the first nozzle row and the second nozzle row, according to a usage rate of each of the first and second nozzle rows when forming that dot row, the first nozzles of the first nozzle row forming dots on a medium by ejecting liquid while moving in a movement direction, the second nozzles of the second nozzle row forming dots on the medium by ejecting liquid while moving in the movement direction, the dot row that has been formed on the medium being composed of a plurality of the dots to be lined up on the medium in the movement direction, and a function to forming a plurality of the dot rows in the transport direction by alternately repeating a transport operation of transporting the medium in the transport direction and a dot forming operation of forming a dot on the medium by ejecting liquid from the first nozzles and the second nozzles while the first and second nozzles moving in the movement direction, at least one of the dot rows that have been formed by the first and second nozzles being composed of the dots that are varied according to the usage rate of each of the first nozzle row and the second nozzle row.

* * * * *